US006746718B2

(12) United States Patent
Yokota

(10) Patent No.: US 6,746,718 B2
(45) Date of Patent: Jun. 8, 2004

(54) PROCESS OF CURTAIN FOR PRODUCING AN INFORMATION RECORDING MATERIAL

(75) Inventor: Yasuro Yokota, Tokyo (JP)

(73) Assignee: Mitsubishi Paper Mills Ltd., Tokyo (JP)

( * ) Notice: Subject to any disclaimer, the term of this patent is extended or adjusted under 35 U.S.C. 154(b) by 0 days.

(21) Appl. No.: 10/265,911

(22) Filed: Oct. 8, 2002

(65) Prior Publication Data

US 2003/0190432 A1 Oct. 9, 2003

Related U.S. Application Data

(63) Continuation of application No. PCT/JP01/02497, filed on Mar. 27, 2001.

(30) Foreign Application Priority Data

| | | |
|---|---|---|
| Apr. 11, 2000 | (JP) | 2000-109769 |
| Nov. 21, 2000 | (JP) | 2000-354743 |
| Dec. 21, 2000 | (JP) | 2000-388227 |

(51) Int. Cl.[7] ..... B05D 1/30
(52) U.S. Cl. ..... 427/407.1; 427/420
(58) Field of Search ..... 427/420, 407.1; 118/DIG. 4

(56) References Cited

U.S. PATENT DOCUMENTS 4,965,166 A * 10/1990 Hosoi et al. ..... 430/156

FOREIGN PATENT DOCUMENTS

| | | |
|---|---|---|
| JP | 49-24133 | 6/1974 |
| JP | 58-39078 | 8/1983 |
| JP | 59-189967 | 10/1984 |
| JP | 1-2229922 | 9/1989 |
| JP | 4-179578 | 6/1992 |
| JP | 5-4441 | 1/1993 |
| JP | 6-344666 | 12/1994 |
| JP | 7-159925 | 6/1995 |
| JP | 7-164732 | 6/1995 |
| JP | 8-108615 | 4/1996 |
| JP | 9-150571 | 6/1997 |
| JP | 11-34481 | 2/1999 |
| JP | 11-48602 | 2/1999 |
| JP | 11-192777 | 7/1999 |
| JP | 2001-105715 | 4/2001 |

* cited by examiner

*Primary Examiner*—Katherine A. Bareford
(74) *Attorney, Agent, or Firm*—Nixon & Vanderhye P.C.

(57) ABSTRACT

An information recording material having an information recording layer formed on a substrate formed by applying by curtain-coating a coating film comprising two coating solution films of which the viscosity increases when the two coating solution films are brought into contact, or mixed, with each other. An intermediate coating solution film for isolating the two coating solution films one from the other and is provided between the two coating solution films. Alternatively, a curtain-coating composition film having at least one set of adjacent two layers of which the viscosity increases with the passage of time when the two layers are brought into contact, or mixed, with each other. Information recording materials having particularly excellent quality of applied layers and excellent in various properties with good productivity.

4 Claims, No Drawings

PROCESS OF CURTAIN FOR PRODUCING AN INFORMATION RECORDING MATERIAL

This application is the continuation of international application PCT/JP01/02497 filed Mar. 27, 2001, which designated the US, the entire contents of which are incorporated herein by this reference.

FIELD OF THE INVENTION

The present invention relates to a process for producing an information recording material and a coating solution for use therein. More specifically, the present invention relates to a process for well productively producing an information recording material such as a thermal recording material or an inkjet recording material excellent particularly in the quality of coating layers and excellent in various properties, and a coating solution for use in this process.

TECHNICAL BACKGROUND

Information recording materials having an information-recording layer formed on a substrate are used in broad fields. A variety of recording materials such as a pressure-sensitive recording material, a heat-sensitive recording material, a photo-sensitive heat-sensitive recording material, a photo-sensitive pressure-sensitive recording material, a thermal transfer recording material, an inkjet recording material, etc., are practically used as such information recording materials. In recent years, information recording materials having two or more layers formed on a substrate are also used to comply with demands for higher functions and higher performances.

A thermal recording material is generally a material in which a heat-sensitive recording layer containing a thermally color-formable material is formed on a substrate. The thermal recording material is heated with a thermal head (hot head), a thermal pen, laser light, or the like, to form an image.

The above thermal recording material is advantageous in that a recording can be obtained with a relatively simple unit, that maintenance is easy and that no noise is made, so that it is widely used in the fields of measuring recorders, facsimile machines, printing machines, computer terminals, labels, automatic vending machines of tickets, etc. In recent years, further, for attaining superior color density and sensitivity, image stability and tones of a plurality of colors, there are practically used thermal recording materials having at least one protective layer or undercoat layer or both and two or more heat-sensitive recording layers, in addition to a thermal recording material having a single heat-sensitive recording layer alone.

An inkjet recording method is a method in which fine globules of an ink are ejected from an inkjet recording device and allowed to adhere to an inkjet recording material to form an image or letters. As the above inkjet recording material, a material such as a non-coated paper having no ink receptor layer is sometimes used. However, an ink receptor layer is formed on a substrate for use when printing is made on a synthetic resin film having no ink-reception properties or when it is intended to obtain a finer image. With diversification in use, color imaging or higher performances such as faster printing in recent years, a larger amount of an ink is ejected, and a higher-capacity ink absorption and a higher print density come to be required. Since no sufficient performances for the above requirements can be obtained with any conventional single ink receptor layer, an inkjet recording material having two or more ink receptor layers are practically used as well.

In a conventional information recording material having two or more layers laminated on a substrate, each layer is independently formed by application and drying to form the laminated layers, and the application is carried out by a method such as an air knife coating method, a blade coating method, a rod coating method or a reverse roll coating method. However, an information recording material prepared by any one of the above methods has problems that the quality of coating layers is poor, that an upper layer has pin holes caused by infiltration of an upper layer coating solution into a lower layer and repellency during application to form the upper layer and that the quality varies due to continuous coating for a long period of time. Moreover, there are problems in a limit to application at a high rate and a decrease in productivity due to application procedures to be carried out a plurality of times.

As compared with these methods, the curtain coating method disclosed in Japanese Patent Publication No. 49-24133, etc., is a method in which a free-fall curtain of a coating solution is formed and allowed to collide with a substrate to apply the coating solution to the substrate, and it is known that the curtain coating method achieves a good quality of coating layers and has suitability to application at a high rate. Further, since a plurality of layers can be simultaneously formed by curtain-coating of a coating composition film formed of a plurality of coating solution layers, the productivity in multi-layer application can be improved to a great extent. In the simultaneous multi-layer application using a curtain coating method, the coating composition film made of a plurality of coating solution layers is formed, and thereafter, it is required to dry the coating composition film to solidness without disturbing the layer structure thereof. When the layer structure is disturbed to cause an intermingling of layers, the layers comes to exhibit no sufficient functions thereof, so that an information recording material is degraded in various properties. In the field of conventional photographic photosensitive materials prepared by simultaneous multi-layer application using a curtain coating method, generally, each coating solution contains gelatin as a binder, and coating composition layers are cooled immediately after coating composition solutions are transferred onto a substrate, so that the coating solutions are immobilized by gelling of the gelatin therein, whereby no intermingling of the layers takes place.

In the information recording material, for example, in a heat-sensitive recording material, there is a problem that addition of gelatin sufficient for immobilizing coating solutions by cooling degrades various properties such as color-formability, image stability, etc., to a great extent. An inkjet recording material involves problems that no sufficient ink absorption capacity or absorption rate can be obtained. Further, there has been found no method of immobilizing coating solutions with any other substance than gelatin without impairing the above properties, and it is not yet possible to prevent the intermingling of layers by a method similar to the method employed for a photographic photosensitive material.

Meanwhile, unlike a photographic photosensitive material, most of information recording materials use a substrate having a very high water absorbing property such as paper, and a layer having a high water absorbing property is pre-coated on a substrate in many cases. When a coating composition film made of a plurality of layers of coating solutions is curtain-coated on such a substrate, water in the coating solution of the lowermost layer constituting the above coating composition film migrates into the substrate or a layer pre-coated on the substrate, and water in the coating solution of one upper layer accordingly migrates into another lower layer. The problem is that non-water components contained in layers also migrate from one upper layer to another lower layer due to the migration of water and cause the intermingling of layers.

DISCLOSURE OF THE INVENTION

It is a first object of the present invention to overcome the above drawbacks of prior art and provide a process for efficiently producing an information recording material such as a heat-sensitive recording material, an inkjet recording material, or the like, which is particularly excellent in the quality of coating layers and excellent in various properties.

It is a second object of the present invention to provide coating solutions suitable for use in the above process.

The present inventors have made diligent studies for achieving the above objects, and as a result, in the process for the production of an information recording material having an information recording layer formed on a substrate, it has been found that the first object can be achieved by (1) curtain-coating a coating composition film comprising two coating solution films that come to have a high viscosity when brought into contact, or mixed, with each other and an intermediate coating solution film that is for isolating said two coating solution films one from the other and is provided between said two coating solution films, to form the information recording layer;

(2) curtain-coating a coating composition film made of a plurality of layers to form part or the entirety of a plurality of layers constituting the information recording material, wherein at least one set of adjacent two layers constituting the coating composition film made of a plurality of layers to be curtain-coated has a constitution in which the viscosity of the adjacent two layers increases with the passage of time when the two layers are brought into contact, or mixed, with each other;

(3) curtain-coating a coating composition film made of a plurality of layers to form part or the entirety of a plurality of layers constituting the information recording material, wherein water or an aqueous liquid is applied to a substrate surface on which said coating composition film is to be formed, and immediately thereafter said coating composition film is curtain-coated in a non-dry state of the substrate to form the information recording layer; or (4) curtain-coating a coating composition film made of a plurality of layers to form part or the entirety of a plurality of layers constituting the information recording material, wherein a coating solution containing at least 90% by weight of water on the basis of the total weight of said coating solution is used as a coating solution for a lowermost layer constituting said coating composition film made of a plurality of layers to be curtain-coated.

Further, it has been found that the second object can be achieved by a combination of three coating solutions having specific properties, which are for use in the above process (1), and a combination of two coating solutions having specific properties, which are for use in the above process (2).

The present invention has been completed on the basis of the above findings.

That is, the present invention provides, (1) a process for producing an information recording material having an information recording layer formed on a substrate, which comprises curtain-coating a coating composition film made of a plurality of layers on the substrate to form the information recording layer,
said coating composition film comprising two coating solution films of which the viscosity increases when they are brought into contact, or mixed, with each other and an intermediate coating solution film that is for isolating said two coating solution films one from the other and is provided between said two coating solution films (to be referred to as "production process I" hereinafter), (2) a process for producing an information recording material having an information recording layer formed on a substrate, which comprises curtain-coating a coating composition film made of a plurality of layers to form part or the entirety of a plurality of layers constituting the information recording material,
said coating composition film comprising at least one set of adjacent two layers of which the viscosity increases with the passage of time when they are brought into contact, or mixed, with each other (to be referred to as "production process II" hereinafter), (3) a process for producing an information recording material having an information recording layer formed on a substrate, which comprises curtain-coating a coating composition film made of a plurality of layers to form part or the entirety of a plurality of layers constituting the information recording material,
wherein water or an aqueous liquid is applied to a substrate surface on which said coating composition film is to be formed, and immediately thereafter said coating composition film is curtain-coated in a non-dry state of the substrate to form the information recording layer (to be referred to as "production process III" hereinafter), (4) a process for producing an information recording material having an information recording layer formed on a substrate, which comprises curtain-coating a coating composition film made of a plurality of layers to form part or the entirety of a plurality of layers constituting the information recording material,
wherein a coating solution of a lowermost layer constituting the coating composition film made of a plurality of layers to be curtain-coated contains at least 90% by weight, based on the total weight of said coating solution, of water (to be referred to as "production process IV" hereinafter), (5) coating solutions for use in the above production process I, which are a combination of two coating solutions of which the viscosity increases when the two coating solutions are brought into contact, or mixed, with each other, with a coating solution that is for use as an intermediate coating solution for isolating the two coating solutions and shows no increase in viscosity when brought into contact, or mixed, with either of the two coating solutions (to be referred to as "coating solutions I" hereinafter), and (6) coating solutions for use in the above production process II, which are a combination of two coating solutions of which the viscosity increases with the passage of time when the two coating solutions are brought into contact, or mixed, with each other (to be referred to as "coating solutions II" hereinafter).

The term "coating solution" includes dispersions of solid particles in a liquid, depending upon the ingredients contained therein.

PREFERRED EMBODIMENTS OF THE INVENTION

In the process for producing an information recording material in the present invention, part or the entirety of a plurality of layers constituting the information recording material are formed by curtain-coating a coating composition film made of a plurality of layers and then drying it. The layers to be formed by curtain-coating are not specially limited in kind. Examples of such layers in a heat-sensitive recording material include an undercoat layer, a heat-sensitive recording layer, a protective layer, and the like, and examples of such layers in an inkjet recording material include an undercoat layer, an ink receptor layer, and the like. A combination of these adjacent layers are together simultaneously applied by curtain-coating. Specific examples of a combination of the layers that are simultaneously applied in a heat-sensitive recording material includes a combination of an undercoat layer and a heat-sensitive recording layer, a combination of a heat-sensitive recording layer and a protective layer, a combination of an undercoat layer, a heat-sensitive recording layer and a protective layer, a combination of two or more different undercoat layers, a combination of two or more different heat-sensitive recording layers and a combination of two or more different protective layers. Specific examples of such a combination in an inkjet recording material include a combination of an undercoat layer and an ink receptor layer and a combination of a plurality of ink receptor layers, while there is no special limitation to be imposed on other combinations.

Although not specially limited, an applicator machine for forming the coating composition film made of a plurality of coating solution layers on a substrate includes an extrusion hopper type curtain coater and a slide hopper type curtain coater. The slide hopper type curtain coater disclosed in Japanese patent Publication No. 49-24133, which is for use for forming a photographic photosensitive material, etc., is particularly preferably used. This slide hopper type curtain coater makes it easier to apply the coating composition film made of a plurality of layers.

When general coating solutions for an information recording material are applied with the above curtain coater to form a plurality of layers constituting an information recording material, these coating solutions do not undergo gelling and immobilization unlike coating solutions for a photographic photosensitive material, so that intermingling of layers gradually proceeds immediately after application until drying completes. If intermingling of layers takes place, the layers cannot exhibit sufficient performances, and there can be obtained no information recording material excellent in various properties. For example, in a heat-sensitive recording material, when an undercoat layer and a heat-sensitive recording layer are formed by simultaneous multi-layer application according to curtain coating and when the undercoat layer and heat-sensitive recording layer undergo intermingling, the color density decreases. When a heat-sensitive recording layer and a protective layer are formed by simultaneous multi-layer application according to curtain coating and when the heat-sensitive recording layer and the protective layer undergoes intermingling, there are caused problems of a decrease in color density, a decrease in barrier properties of the protective layer and a difficulty in printing. In an inkjet recording material, further, when a plurality of ink receptor layers undergo intermingling, the color density decreases, and the ink absorption capacity and the ink absorption rate decrease. If such an intermingling of layers takes place, the layers cannot exhibit sufficient functions.

The process for producing an information recording material in the present invention includes four embodiments, the following production processes I to IV, for preventing the above intermingling of layers. Each production process will be explained below.

First, in the production process I of an information recording material in the present invention, for preventing the intermingling of layers, a coating composition film made of a plurality of layers is curtain-coated on a substrate, said a coating composition film comprising two coating solution films of which the viscosity increases when the two coating solution films are brought into contact, or mixed, with each other and an intermediate coating solution film that is for isolating said two coating solution films one from the other and is provided between said two coating solution films, and the applied coating composition film is dried. As inter-mixing of layers during drying proceeds, the two layers sandwiching the intermediate coating solution layer comes to be partially mixed with the intermediate coating solution layer, and as the inter-mixing further proceeds, the intermediate coating solution layer and the two layers sandwiching the intermediate coating solution layer comes to be in a partially mixed state to have a high viscosity. Further inter-mixing of the layers is therefore inhibited, and although the two coating solution films of which the viscosity increases when they are brought into contact, or mixed, with each other are partially mixed, major parts of these layers are not at all mixed, so that the layers can exhibit their sufficient functions.

The intermediate coating solution in the production process of the information recording material in the present invention is used for preventing the two coating solutions sandwiching the intermediate coating solution layer from coming into contact, or getting mixed, with each other to have a high viscosity before the coating composition film is applied to a substrate. The intermediate coating solution is therefore required not to show an increase in viscosity when it comes in contact, or gets mixed, with any one of the two coating solutions sandwiching the intermediate coating solution layer. Further, the intermediate coating solution is also required not to prevent an increase in viscosity when the two coating solutions sandwiching the intermediate coating solution layer comes into contact, or get mixed, with each other. Any intermediate coating solution can be used without any special limitation so long as it has the above properties and suitability to curtain-coating. Further, preferably, the intermediate coating solution does not prevent functions of the two coating solutions sandwiching the intermediate coating solution layer.

When curtain-coating is carried out in a state where two coating solution layers of which the viscosity increases when brought into contact, or mixed, with each other are in contact without providing the intermediate coating solution layer, the two coating solutions increase in viscosity, or if the curtain-coating is possible, the constitution of layers is disturbed. Further, when the intermediate coating solution layer has an insufficient thickness, a similar phenomenon takes place, so that the intermediate layer is required to have a sufficient thickness for preventing a contact between the two coating solution layers before they are applied to a substrate.

The two coating solutions that are used with the intermediate coating solution layer sandwiched between them and show an increase in viscosity when brought into contact, or mixed, with each other are not specially limited. When the two coating solutions that are to be applied with the intermediate coating solution layer sandwiched between them have no function of increasing in viscosity when brought into contact, or mixed, with each other, proper additives can be incorporated into these two coating solutions, respectively, so that the coating solutions can exhibit the function of increasing in viscosity when brought into contact, or mixed, with each other.

The combination of the additives to be incorporated into the two coating solutions for attaining an increase in viscosity when the two coating solutions are brought into contact, or mixed, with each other includes a combination of a positively charged polymer compound with a negatively charged low-molecular-weight compound, a combination of a negatively charged polymer compound with a positively charged low-molecular-weight compound, a combination of a positively charged polymer compound with a negatively charged polymer compound, a positively charged low-molecular-weight compound with a negatively charged low-molecular-weight compound, and a combination of a polyvalent metal ion with a polymer compound that is insolubilized upon a reaction with it, although the above combination shall not be limited thereto.

The positively charged polymer compound includes an oligomer and a polymer of primary to tertiary amines and quaternary ammonium salt. Specific examples thereof include a dimethylamine-epichlorohydrin condensate, an acrylamidediallylamine copolymer, a polyvinylamine polymer, chitosan, and salts of these, while the positively charged polymer compound shall not be limited thereto.

The negatively charged polymer compound includes an oligomer and a polymer containing a carboxyl group, a sulfone group or a sulfino group. Specific examples thereof include polyacrylic acid, a acrylate copolymer, polymethacrylic acid, methacrylate copolymer, polyvinylsufonic acid, a vinylsulfonate copolymer, polyvinylsulfinic acid, alginic acid, carageenan, pectin, furcellaran, carboxymethylcellulose, heparin, chondroitin sulfate, xanthan gum, gum Arabic, guar gum and salts of these, while the negatively charged polymer compound shall not be limited thereto.

The polymer compound that is insolubilized upon a reaction with a polyvalent metal ion includes, for example, alginic acid, carboxymethylcellulose, pectin and salts of these, while above polymer compound shall not be limited thereto.

The negatively charged low-molecular-weight compound includes, for example, inorganic acids such as hydrochloric acid, sulfuric acid and nitric acid, and organic acids such as carboxylic acids, sulfonic acids and sulfinic acids, while the above compound shall not be limited thereto.

The positively charged low-molecular-weight compound includes, for example, inorganic bases such as sodium hydroxide, potassium hydroxide and ammonia, and organic bases such as primary to tertiary amines or quaternary ammonium salts, e.g. dicyandiamide or dimethyldiallylammonium chloride, although the above compound shall not be limited thereto.

The polyvalent metal ion includes, for example, calcium ion, magnesium ion, aluminum ion, zinc ion, boron ion and iron ion, while the polyvalent metal ion shall not be limited thereto.

Preferably, the additives to the coating solutions for causing the viscosity of the two coating solutions to increase when brought into contact, or mixed, with each other can attain a higher viscosity when they are added in a smaller amount. Further, preferably, the additives can attain a high viscosity in a shorter period of time after the two coating solutions are brought into contact, or mixed, with each other.

The coating solutions I of the present invention are coating solutions for use in the above production process I and are a combination of two coating solutions of which the viscosity increases when the two coating solutions are brought into contact, or mixed, with each other, with a coating solution that is for use as an intermediate coating solution for isolating the two coating solutions and shows no increase in viscosity when brought into contact, or mixed, with either of the two coating solutions.

Preferably, the two coating solutions of which the viscosity increases when brought into contact, or mixed, with each other respectively contain, as additives, a positively charged polymer compound and a negatively charged low-molecular-weight compound in combination, a negatively charged polymer compound and a positively charged low-molecular-weight compound in combination, a positively charged polymer compound and a negatively charged polymer compound in combination, a positively charged low-molecular-weight compound and a negatively charged low-molecular-weight compound in combination, or a polyvalent metal ion and a polymer compound that is insolubilized upon a reaction with it in combination, In the production process II of an information recording material in the present invention, at least one set of two adjacent layers constituting a coating composition film made of a plurality of layers for curtain-coating are prepared so as to increase in viscosity with the passage of time when brought into contact, or mixed, with each other, and the coating composition film is applied. The two adjacent layers that increase in viscosity with the passage of time when brought into contact, or mixed, with each other are required to gradually increase in viscosity with the passage of time after brought into contact, or mixed, with each other. When the two layers instantly have a high viscosity upon contact or mixing, the layer constitution of the coating composition film is disturbed after the coating composition film made of a plurality of layers is formed and before it is applied to a substrate, or the coating composition film per se cannot be formed. It is therefore required to adjust the rate and degree of an increase in viscosity which increase takes place after the above two layers are brought into contact, or mixed, with each other, in conformity with coating solutions and an applicator machine, such that the layer constitution is not disturbed before application of the coating composition film on a substrate. After application of the coating composition film to a substrate, an increase in viscosity proceeds due to the contact or mixing, and most parts of these layers undergo no mixing and show an excellent layers-separated state.

The combination of the coating solutions that gradually increase in viscosity after brought into contact, or mixed, with each other is not specially limited. Proper additives can be incorporated into the two coating solutions, respectively, so that the coating solutions can exhibit the function of gradually increasing in viscosity when brought into contact, or mixed, with each other.

The combination of the additives that are incorporated into the coating solutions for gradually increasing the viscosity of the two coating solutions with the passage of time after their contact or mixing specifically includes, for example, a combination of an alkali and an emulsion of a carboxyl-group-containing polymer that is soluble upon a reaction with the alkali, while the above combination shall not be limited thereto.

The emulsion of a carboxyl-group-containing polymer soluble upon a reaction with an alkali includes an emulsion of a copolymer of acrylic acid, methacrylic acid, maleic acid or fumaric acid with other monomer. Such an emulsion exists as a water insoluble emulsion in an acidic-neutral region since the carboxyl group contained in the polymer has a low degree of dissociation and therefore has no solubility in water. When an alkali is added to the above emulsion, the carboxyl group is dissociated and the emulsion exhibits its solubility in water, so that the emulsion is gradually dissolved in water to cause a gradual increase in viscosity. The rate of an increase in viscosity can be controlled on the basis of the particle diameter of the emulsion and the content of the carboxyl group.

Preferably, the additives to the coating solutions for causing the viscosity of the two coating solutions to gradually increase with the passage of time after brought into contact, or mixed, with each other can attain a higher viscosity when they are added in a smaller amount.

When a plurality of layers for constituting an information recording material are applied by multi-layered simultaneous application with the above applicator machine for curtain-coating, generally, the surface tension of an uppermost layer coating solution is essentially adjusted to be equivalent to, or lower than, the surface tension of a lower layer coating solution in order to prevent a repellency phenomenon that the uppermost layer shrinks on the lower layer to cause a defect on the uppermost layer. The above uppermost layer refers to a layer farthest from a substrate, and the above lower layer refers to a layer nearer to the substrate. For adjusting the surface tension, there is employed a method in which surfactants are added to the coating solutions to decrease their surface tensions. On the other hand, it is very difficult to increase the surface tension of any coating solution, and such is not generally carried out. For the above purpose, it is necessary to add a larger amount of a surfactant to the uppermost layer coating solution in order to attain a lower surface tension. In an information recording material, for example, in a heat-sensitive recording material, addition of a large amount of a surfactant to the coating solutions involves drawbacks that the heat-sensitive recording material is degraded in various properties such as color forming and image stability and further that it is difficult to control the wettability of water and oil to the heat-sensitive recording material. In an inject recording material, the ink-absorbing capability and he print density are greatly susceptible to a surfactant, no intended quality may be obtained in some cases. The method of preventing repellency of the uppermost layer by adding a surfactant has a defect that the performances of an information recording material are limited as described above.

In the production process II of an information recording material in the present invention, the uppermost layer coating solution may have a higher surface tension than the adjacent lower layer coating solution. After the uppermost layer coating solution and the adjacent lower layer coating solution are brought into contact, or mixed, with each other, the viscosity thereof increases with the passage of time, whereby there can be prevented the repellency phenomenon that the uppermost layer shrinks on the lower layer.

The rate of an increase in viscosity of the upper layer coating solution and the adjacent lower layer coating solution after they are brought into contact, or mixed, with each other is required to be a rate sufficient for preventing the repellency phenomenon. For the above reasons, it is required to adjust the rate and degree of an increase in viscosity which increase takes place after the above two layers are brought into contact, or mixed, with each other, in conformity with to coating solutions and an applicator machine, such that the repellency phenomenon can be prevented and that the layer constitution is not disturbed before application of the coating composition film to a substrate.

The coating solutions II of the present invention are used in the above production process II and are a combination of two coating solutions which increase in viscosity with the passage of time when brought into contact, or mixed, with each other. Preferably, one of the above two coating solutions contains an emulsion of a carboxyl-group-containing polymer soluble upon a reaction with an alkali, and the other contains an alkali, so that the emulsion and the alkali are combined. Further, suitably, the two coating solutions are a combination of two coating solutions having different surface tensions.

In the production process III of an information recording material in the present invention, for preventing intermingling of layers, water or an aqueous liquid is applied to a substrate in advance so that the substrate absorbs water before curtain-coating, and after such is completed, the curtain-coating is carried out. By the above operation, shifting of water into the substrate side is suppressed when the curtain-coating is carried out, and a major part of the applied layers are not at all intermingled and show an excellent layer-separated state.

In the present invention, the curtain-coating is carried out with a curtain-coating applicator machine to form a coating composition film. Before the coating composition film is formed, water or an aqueous liquid is applied to the substrate surface on which the coating composition film is to be formed. As a liquid to be applied, water alone may be used. However, an aqueous liquid containing a material soluble or dispersible in water is preferred.

Although not specially limited, examples of the above material soluble or dispersible in water are as follows.

The above materials include water-soluble polymers such as a starch polymer, a polyvinyl alcohol polymer, a gelatin polymer, a polyacrylamide polymer and a cellulose polymer, emulsions and latexes such as a petroleum resin emulsion, an emulsion or latex of a copolymer having at least components from ethylene and acrylic acid (or methacrylic acid), and an emulsion or latex of a styrene-butadiene, styrene-acrylate, vinyl acetate-acrylate, ethylene-vinyl acetate or butadiene-methyl methacrylate copolymer or a carboxy-modified copolymer of any one of these. Further, the coating solutions may contain an alkali metal salt such as sodium chloride or potassium chloride, an alkaline earth metal salt such as calcium chloride or barium chloride, a colloidal metal oxide such as colloidal silica, an organic antistatic agent such as polystyrenesulfonate, a pigment such as clay, kaolin, calcium carbonate, talc, barium sulfate or titanium oxide, a pH adjuster such as hydrochloric acid, phosphoric acid, citric acid or sodium hydroxide, and additives such as a coloring pigment, a coloring dye or a fluorescent brightener. The above materials may be used in combination as required.

In the above production process III, the machine for applying water or an aqueous liquid to a substrate surface is not specially limited. There may be used a generally known applicator machine. For example, it can be selected from coating machines according to different liquid application methods such as pressure fountain, jet fountain, flooded nip, roll metering, rod metering and curtain coaters, or application-amount-adjustable machines such as blade, rod, roll nip and air knife coaters. These coaters may be used in combination as required.

Further, in the production process IV of an information recording material in the present invention, a coating solution of a lowermost layer constituting the coating composition film made of a plurality of layers to be curtain-coated contains at least 90% by weight, based on the total weight of said coating solution, of water for preventing intermingling of layers. When the lowermost layer coating solution has a water content of at least 90% by weight based on the total weight of the said coating solution, shifting of water from an upper layer does not easily take place even if water in the lowermost layer coating solution moves to the substrate or an undercoat layer applied to the substrate beforehand, since the lowermost layer coating solution has a sufficient content of water, so that the upper layer is dried before the intermingling of layers proceeds and the intermingling of layers is prevented.

The lowermost layer coating solution is not specially limited so long as it contains at least 90% by weight, based on the total weight of the coating solution, of water. Therefore, the lowermost layer coating solution may be a coating solution essential for materializing the function of an information recording material, or it may be a layer that is provided for preventing the intermingling of layers but has no direct relationship to the function of an information recording material.

The lowermost layer coating solution preferably contains a component film-formable after drying, since shifting of water can be more effectively prevented. Specific examples of the component film-formable after drying include water-soluble polymers such as polyvinyl alcohols, starches, celluloses, polyacrylamides, an alkali salt of a styrene/maleic anhydride copolymer and an alkali salt of an ethylene/maleic anhydride copolymer, polyacrylic acid; and emulsions of synthetic resins such as polymethacrylic acid, polyacrylic ester, polymethacrylic ester, a styrene/butadiene copolymer, an acrylonitrile/butadiene copolymer, an ethylene/vinyl acetate copolymer, an acrylic acid amide/acrylic ester copolymer and an acrylic acid amide/acrylic ester/methacrylic acid terpolymer.

In the production processes I to IV of an information recording material in the present invention, the method of drying is not critical. Specifically, the drying method includes, for example, a method of blowing hot air, a method of blowing dry air, a method of irradiation with an infrared ray, a method of irradiation with microwave, and these methods may be used in combination.

In the production processes I to IV of an information recording material in the present invention, coating solutions of plurality of layers constituting the coating composition film to be applied are used after the viscosity and surface tension thereof are adjusted for decreasing the intermingling of layers during curtain-coating. When a viscosity difference among the layers is small, the degree of intermingling of layers is low. The viscosity difference among the layers is preferably 100 mPa.s or less. When the surface tension of one coating solution to form one lower layer is smaller than the surface tension of another coating solution to form an upper layer, undesirably, there occurs a phenomenon that the coating solution forming the upper layer is repelled on the coating solution forming the lower layer, and no uniform coating composition film is formed, so that the quality of a film formed by application is sometimes degraded. When these layers have the same surface tensions, desirably, the repellency phenomenon does not easily take place. When the surface tension of a coating solution to form an upper layer is adjusted to be smaller than the surface tension of a coating solution to form a lower layer, particularly desirably, an excellent quality of a film formed by application is obtained. When three or more layers are simultaneously applied, preferably, the surface tensions of these layers are adjusted such that the surface tension decreases successively in the order of from the lowermost layer, i.e., a layer nearest to a substrate to the uppermost layer that is farthest from the substrate. However, the above is not applicable to the surface tensions of the coating solution of the uppermost layer and the coating solution of the adjacent lower layer in the production process II of an information recording material in the present invention.

For adjusting the viscosities of the coating solutions, there may be employed a method of mixing a water-soluble polymer such as polyvinyl alcohol, starch or carboxymethylcellulose, or a thickener such as an acrylic emulsion with a coating solution to increase the viscosity thereof, a method of increasing a solid content in a coating solution to increase the viscosity or a method of diluting a coating solution to decrease the viscosity.

For adjusting the surface tensions of the coating solutions, any amount of an anionic surfactant such as carboxylic acid salt, sulfonic acid salt, sulfuric ester salt or phosphoric ester salt, a nonionic surfactant such as an ether type, ether-ester type, ester type or nitrogen-containing surfactant or an amphoteric surfactant such as betain, aminocarboxylic acid salt or an imidazoline derivative may be mixed with the coating solutions.

In the production processes I to IV of an information recording material in the present invention, the coating solutions of a plurality of layers constituting the coating composition film to be applied may contain a pigment dispersing agent, a thickener, a fluidity improver, an anti-foaming agent, a foaming suppressor, a release agent, a foaming agent, a penetrating agent, a coloring dye, a coloring pigment, a fluorescent brightener, an anti-oxidant, an antiseptic agent, a mildewproofing agent, a water-resistance-imparting agent, a wet strength agent, a dry strength agent, etc., as required.

Each layer of an information recording material produced in each of the production processes I to IV in the present invention may contain an optional binder. Specific examples of the binder include starches, hydroxyethylcellulose, methylcellulose, ethylcellulose, carboxymethylcellulose, gelatin, casein, polyvinyl alcohol, modified polyvinyl alcohol, polyacrylic acid, polymethacrylic acid, polyacrylic ester, polymethacrylic ester, sodium polyacrylate, polyethylene terephthalate, polybutylene terephthalate, chlorinated polyether, an allyl resin, a furan resin, a ketone resin, oxybenzoyl polyester, polyacetal, polyether ether ketone, polyether sulfone, polyimide, polyamide, polyamideimide, polyaminobismaleimide, polymethylpentene, polyphenylene oxide, polyphenylene sulfide, polyphenylene sulfone, polysulfone, polyarylate, polyallylsulfone, polybutadiene, polycarbonate, polyethylene, polypropylene, polystyrene, polyvinyl chloride, polyvinylidene chloride, polyvinyl acetate, polyurethane, a phenolic resin, a urea resin, a melamine resin, a melamine formalin resin, a benzoguanamine resin, a bismaleimide triazine resin, an alkyd resin, an amino resin, an epoxy resin, an unsaturated polyester resin, a styrene/butadiene copolymer, an acrylonitrile/butadiene copolymer, a methyl acrylate/butadiene copolymer, an ethylene/vinyl acetate copolymer, an acrylic acid amide/acrylic ester copolymer, an acrylic acid amide/acrylic ester/methacrylic acid terpolymer, an alkali salt of a styrene/maleic anhydride copolymer, an alkali salt or ammonium salt of an ethylene/maleic anhydride copolymer and other various polyolefin resins. These binders may be used alone or as a mixture containing at least two binders of these.

The substrate for use in the information recording material to be produced by any one of the production processes I to IV of an information recording material in the present invention may be any one of transparent, semi-transparent and opaque substrates. The above substrate can be selected from paper, various non-woven fabrics, woven fabrics, a synthetic resin film, a synthetic resin laminated sheet, a synthetic paper, a metal foil, a ceramic sheet, a glass sheet or a composite sheet made of a combination thereof as required depending upon a purpose, while the substrate shall not be limited thereto.

Any layer of an information recording material produced by any one of the production processes I to IV of an information recording material in the present invention may contain inorganic and organic pigments such as diatomaceous earth, talc, kaolin, calcined kaolin, calcium carbonate, magnesium carbonate, titanium oxide, zinc oxide, silicon oxide, aluminum hydroxide and a urea-formalin resin as required. In addition to these, it may also contain higher fatty acid metal salts such as zinc stearate and calcium stearate, waxes such as paraffin, paraffin oxide, polyethylene, polyethylene oxide, stearic acid amide and castor wax, a dispersing agent such as sodium dioctylsulfosuccinate, a surfactant and a fluorescent dye as required.

Further, an antioxidant and an ultraviolet absorbent may be incorporated for improving the information recording material in light resistance. Examples of the antioxidant include a hindered-amine-containing antioxidant, a hindered-phenol-containing antioxidant and a sulfide-containing antioxidant, while the antioxidant shall not be limited thereto. Examples of the ultraviolet absorbent include organic ultraviolet absorbents such as a benzotriazole ultraviolet absorbent, a salicylic acid ultraviolet absorbent and a benzophenone ultraviolet absorbent, and inorganic ultraviolet absorbents such as zinc oxide, titanium oxide and cerium oxide, while the ultraviolet absorbent shall not be limited thereto.

In a heat-sensitive recording material produced by any one of the production processes I to IV of an information recording material in the present invention, a component that forms a color by heating is not specially limited. Examples of the above component includes a combination of a generally colorless or light-colored electron-donating dye precursor with an electron-accepting compound, a combination of an aromatic isocyanate compound with an imino compound, a combination of a generally colorless or light-colored electron-donating dye precursor with an aromatic isocyanate compound, a combination of a metallic compound with a coordination compound and a combination of a diazonium salt with a coupler. In view of excellence in various properties such as color formability and image stability, it is particularly preferred to use a combination of a generally colorless or light-colored electron-donating dye precursor with an electron-accepting compound, a combination of an aromatic isocyanate compound with an imino compound or a combination of a generally colorless or light-colored electron-donating dye precursor with an aromatic isocyanate compound.

In a heat-sensitive recording material produced by any one of the production processes I to IV of an information recording material in the present invention, any layer of the heat-sensitive recording material may contain a material capable of electrically, magnetically or optically recording information. A surface provided with a heat-sensitive recording layer or a surface opposite thereto may be imparted with the capability of receiving an inkjet recording ink. Further, a surface opposite to a surface provided with a heat-sensitive recording layer may be provided with a back-coating layer for preventing curling or electrostatic charge, and further, this surface may be processed to impart it with adhesiveness. Further, printing with a UV ink, etc., may be carried out on the surface of a heat-sensitive recording layer.

In a heat-sensitive recording material produced by any one of the production processes I to IV of an information recording material in the present invention, any layer of the heat-sensitive recording material and the substrate may contain a light-heat converting material for printing with laser light.

In an inkjet recording material produced by any one of the production processes I to IV of an information recording material in the present invention, both surfaces of a substrate may be provided with an ink receptor layer. Any layer of the inkjet recording material may contain a material capable of electrically, magnetically or optically recording information. Further, a surface opposite to a surface provided with an ink receptor layer may be provided with a back-coating layer for preventing curling or electrostatic charge, and further, this surface may be processed to impart it with adhesiveness.

The present invention will be explained with reference to Examples hereinafter, while the present invention shall not be limited to these Examples. In Examples, "part" stands for "part by weight" and "%" stands for "% by weight" unless otherwise specified.

EXAMPLE 1

(A-1) Preparation of Heat-sensitive Recording Layer Coating Solution

Mixtures having the following compositions were dispersed with a ball mill to give liquids A-1-1, A-1-2 and A-1-3 having a volume average particle diameter of 1 $\mu$m and a liquid A-1-4 having a volume average particle diameter of 2 $\mu$m.

| Liquid A-1-1: | |
|---|---|
| 3-Dibutylamino-6-methyl-7-anilinofluorane | 40 parts |
| 10% Polyvinyl alcohol aqueous solution | 20 parts |
| Water | 40 parts |

| Liquid A-1-2: | |
|---|---|
| 4,4'-Bis(hydroxyphenyl)sulfone | 80 parts |
| 10% Polyvinyl alcohol aqueous solution | 40 parts |
| Water | 80 parts |

| Liquid A-1-3: | |
|---|---|
| 2-Benzyloxynaphthalene | 80 parts |
| 10% Polyvinyl alcohol aqueous solution | 40 parts |
| Water | 80 parts |

| Liquid A-1-4: | |
|---|---|
| Calcium carbonate (Callight SA, supplied by Shiraishi Kogyo Kaisha, Ltd.) | 80 parts |
| Sodium polyacrylate | 1 part |
| Water | 79 parts |

The above-obtained liquids A-1-1, A-1-2, A-1-3 and A-1-4, 600 parts of a 10% polyvinyl alcohol aqueous solution, 200 parts of a 10% sodium alginate aqueous solution, 105 parts of water and 0.67 part of a fluorine-containing surfactant (Surflon S-111, supplied by Asahi Glass Co., Ltd.) were mixed, to obtain a heat-sensitive recording layer coating solution.

(B-1) Preparation of Intermediate Layer Coating Solution 1,500 Parts of a 0.5% hydroxymethylmethylcellulose and 0.80 part of a fluorine-containing surfactant (Surflon S-111, supplied by Asahi Glass Co., Ltd.) were mixed, to prepare an intermediate layer coating solution.

(C-1) Preparation of Protective Layer Coating Solution

A mixture having the following composition was dispersed with a ball mill, to give a liquid C having a volume average particle diameter of 1 $\mu$m.

| Liquid C-1: | |
|---|---|
| Aluminum hydroxide (Higilite H42, supplied by Showa Denko K.K.) | 6 parts |
| Silane-modified polyvinyl alcohol (R2105, supplied by Kuraray Co., Ltd.) | 0.1 part |
| Water | 13.9 parts |

The above-obtained liquid C-1, 25 parts of a 40% zinc stearate dispersion, 1,000 parts of a 10% polyvinyl alcohol aqueous solution, 10 parts of calcium chloride, 234 parts of water and 0.90 part of a fluorine-containing surfactant (Surflon S-111, supplied by Asahi Glass Co., Ltd.) were mixed to obtain a protective layer coating solution.

(D-1) Preparation of Heat-sensitive Recording Material

With a slide hopper type curtain coater, a coating composition film made of a heat-sensitive recording layer coating solution, an intermediate coating solution and a protective layer coating solution in this order from a lower layer side was formed from the heat-sensitive recording layer coating solution, the intermediate coating solution and the protective layer coating solution prepared in (A-1), (B-1) and (C-1) such that the coating composition film had, per meter of a curtain width, a heat-sensitive recording layer coating solution flow rate of 4,000 ml/minute, an intermediate coating solution flow rate of 200 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to give a heat-sensitive recording material. When the heat-sensitive recording layer coating solution and the protective layer coating solution in this Example were mixed, the viscosity of the mixture increased to a high level.

EXAMPLE 2

A heat-sensitive recording material was prepared in the same manner as in Example 1 except that 200 parts of the 10% sodium alginate aqueous solution in (A-1) of Example 1 was replaced with 200 parts of an aqueous solution containing 10% of lactic acid salt of chitosan and that 10 parts of calcium chloride in (C-1) of Example 1 was replaced with 10 parts of 28% aqueous ammonia. When the heat-sensitive recording layer coating solution and the protective layer coating solution in this Example were mixed, the viscosity of the mixture increased to a high level.

EXAMPLE 3

A heat-sensitive recording material was prepared in the same manner as in Example 1 except that 10 parts of calcium chloride in (C-1) of Example 1 was replaced with 10 parts of the 90% lactic acid aqueous solution. When the heat-sensitive recording layer coating solution and the protective layer coating solution in this Example were mixed, the viscosity of the mixture increased to a high level.

EXAMPLE 4

A heat-sensitive recording material was prepared in the same manner as in Example 1 except that 200 parts of 10% sodium alginate aqueous solution in (A-1) of Example 1 was replaced with 200 parts of the aqueous solution containing 10% of lactic acid salt of chitosan and that 1,000 parts of the 10% polyvinyl alcohol aqueous solution, 10 parts of the calcium chloride and 234 parts of the water in (C-1) of Example 1 were replaced with 800 parts of a 10% polyvinyl alcohol aqueous solution, 200 parts of a 10% sodium alginate aqueous solution and 244 parts of water. When the heat-sensitive recording layer coating solution and the protective layer coating solution in this Example were mixed, the viscosity of the mixture increased to a high level.

EXAMPLE 5

(E-1) Preparation of Lower Ink Receptor Layer Coating Solution

A mixture having the following composition was stirred with a homo-mixer to prepare a lower ink receptor layer coating solution.

| Lower ink receptor layer coating solution: | |
|---|---|
| Synthetic amorphous silica (Mizukasil P78D, supplied by Mizusawa Industrial Chemicals, Ltd.) | 28 parts |
| 10 % Polyvinyl alcohol aqueous solution | 40 parts |
| 10 % Sodium alginate aqueous solution | 15 parts |
| Water | 117 parts |
| Fluorine-containing surfactant (Surflon S-111, supplied by Asahi Glass Co., Ltd.) | 0.04 part |

(F-1) Preparation of Intermediate Layer Coating Solution 1,500 Parts of a 0.5% hydroxymethylmethylcellulose aqueous solution and 0.4 part of a fluorine-containing surfactant (Surflon S-111, supplied by Asahi Glass Co., Ltd.) were mixed to prepare an intermediate layer coating solution.

(G-1) Preparation of Upper Ink Receptor Layer Coating Solution

A mixture having the following composition was stirred with a homo-mixer to prepare an upper ink receptor layer coating solution.

| Upper ink receptor layer coating solution: | |
|---|---|
| Synthetic amorphous silica (Finesil X37B, supplied by Tokuyama Corp.) | 21 parts |
| 10% Polyvinyl alcohol aqueous solution | 63 parts |
| Cationic polymer (Sumirez Resin 1001, supplied by Sumitomo Chemical Co., Ltd.) | 14 parts |
| Water | 102 parts |
| Fluorine-containing surfactant (Surflon S-111, supplied by Asahi Glass Co., Ltd.) | 0.002 parts |

(H-1) Preparation of Inkjet Recording Material

With a slide hopper type curtain coater, a coating composition film made of a lower ink receptor layer coating solution, an intermediate coating solution and an upper ink receptor layer coating solution in this order from a lower layer side was formed from the lower ink receptor layer coating solution, the intermediate coating solution and the upper ink receptor layer coating solution prepared in (E-1), (F-1) and (G-1) such that the coating composition film had, per meter of a curtain width, a lower ink receptor layer coating solution flow rate of 7,200 ml/minute, an intermediate coating solution flow rate of 40 ml/minute and an upper ink receptor layer coating solution flow rate of 2,100 ml/minute. And, the coating composition film was applied to a woodfree paper having a basis weight of 60 g/m$^2$ at an application rate of 40 m/minute, and the applied coating composition film was dried to give an inkjet recording material. When the lower ink receptor layer coating solution and the upper ink receptor layer coating solution in this Example were mixed, the viscosity of the mixture increased to a high level.

EXAMPLE 6

An inkjet recording material was prepared in the same manner as in Example 5 except that 15 parts of the 10% sodium alginate aqueous solution in (E-1) of Example 5 was replaced with 15 parts of an aqueous solution containing 10% lactic acid salt of chitosan and that 102 parts of water in (G-1) of Example 5 was replaced with 6 parts of 96 parts of water and 6 parts of 28% aqueous ammonia. When the lower ink receptor layer coating solution and the upper ink receptor layer coating solution in this Example were mixed, the viscosity of the mixture increased to a high level.

EXAMPLE 7

An inkjet recording material was prepared in the same manner as in Example 5 except that 40 parts of the 10% polyvinyl alcohol aqueous solution, 15 parts of the 10% sodium alginate aqueous solution and 117 parts of the water in (E-1) of Example 5 were replaced with 55 parts of a 10% polyvinyl alcohol aqueous solution, 6 parts of 28% aqueous ammonia and 111 parts of water and that 63 parts of the 10% polyvinyl alcohol aqueous solution in (G-1) of Example 5 was replaced with 15 parts of a 10% aqueous solution of lactic acid salt of chitosan and 48 parts of a 10% polyvinyl alcohol aqueous solution. When the lower ink receptor layer coating solution and the upper ink receptor layer coating solution in this Example were mixed, the viscosity of the mixture increased to a high level.

Comparative Example 1

A heat-sensitive recording material was prepared in the same manner as in Example 1 except that 10 parts of the calcium chloride in (C-1) of Example 1 was replaced with 10 parts of water. When the heat-sensitive recording layer coating solution and the protective layer coating solution in this Comparative Example were mixed, the mixture did not increase in viscosity.

Comparative Example 2

A heat-sensitive recording material was prepared in the same manner as in Example 1 except that 600 parts of the 10% polyvinyl alcohol aqueous solution and 200 parts of the 10% sodium alginate aqueous solution in (A-1) of Example 1 were replaced with 800 parts of a 10% polyvinyl alcohol aqueous solution. When the heat-sensitive recording layer coating solution and the protective layer coating solution in this Comparative Example were mixed, the mixture did not increase in viscosity.

Comparative Example 3

A heat-sensitive recording material was prepared in the same manner as in Example 1 except that 600 parts of the 10% polyvinyl alcohol aqueous solution and 200 parts of the 10% sodium alginate aqueous solution in (A-1) of Example 1 were replaced with 800 parts of a 10% polyvinyl alcohol aqueous solution and that 10 parts of the calcium chloride in (C-1) of Example 1 was replaced with 10 parts of water. When the heat-sensitive recording layer coating solution and the protective layer coating solution in this Comparative Example were mixed, the mixture did not increase in viscosity.

Comparative Example 4

An inkjet recording material was prepared in the same manner as in Example 5 except that 40 parts of the 10% polyvinyl alcohol aqueous solution and 15 parts of the 10% sodium alginate aqueous solution in (E-1) of Example 5 were replaced with 55 parts of a 10% polyvinyl alcohol aqueous solution. When the lower ink receptor layer coating solution and the upper ink receptor layer coating solution were mixed in this Comparative Example, the mixture did not increase in viscosity.

Comparative Example 5

An inkjet recording material was prepared in the same manner as in Example 5 except that 15 parts of the 10% sodium alginate aqueous solution in (E-1) of Example 5 was replaced with 15 parts of a 10% aqueous solution of lactic acid salt of chitosan. When the lower ink receptor layer coating solution and the upper ink receptor layer coating solution were mixed in this Comparative Example, the mixture did not increase in viscosity.

Comparative Example 6

An inkjet recording material was prepared in the same manner as in Example 5 except that 40 parts of the 10% polyvinyl alcohol aqueous solution and 15 parts of the 10% sodium alginate aqueous solution in (E-1) of Example 5 were replaced with 55 parts of a 10% polyvinyl alcohol aqueous solution and that 63 parts of the 10% polyvinyl alcohol aqueous solution in (G-1) of Example 5 was replaced with 15 parts of a 10% aqueous solution of lactic acid salt of chitosan and 48 parts of a 10% polyvinyl alcohol aqueous solution. When the lower ink receptor layer coating solution and the upper ink receptor layer coating solution were mixed in this Comparative Example, the mixture did not increase in viscosity.

Test 1 Printing on Heat-sensitive Recording Material with Thermal Head

A print having a width of 5 cm and a length of 5 cm was made on each of the heat-sensitive recording materials prepared in Examples 1 to 4 and Comparative Examples 1 to 3 with a thermal facsimile printing test machine (TH-PMD) supplied by Ohkura Electric Co., Ltd. equipped with a printing head (LH4409) supplied by TDK Corp. at an application pulse of 1.2 milliseconds and an applied voltage of 20 V. Each printed portion was measured for a density with a densitometer (Macbeth RD918). Further, each printed portion was visually observed for a color formation state. Table 1 shows the results.

Test 2 Test of Protective Layer of Heat-sensitive Recording Material for Barrier Properties A print having a width of 5 cm and a length of 5 cm was made on each of the heat-sensitive recording materials prepared in Examples 1 to 4 and Comparative Examples 1 to 3 with a thermal facsimile printing test machine (TH-PMD) supplied by Ohkura Electric Co., Ltd. equipped with a printing head (LH4409) supplied by TDK Corp. at an application pulse of 1.2 milliseconds and an applied voltage of 20 V. Then, castor oil was applied to each printed portion, and after 2 hours, each of the castor-oil-applied portions was measured for a density with a densitometer (Macbeth RD918). Table 2 shows the results.

Test 3 Printing on Inkjet Recording Material with Inkjet Printer

A print having a width of 5 cm and a length of 5 cm was made on each of the inkjet recording materials obtained in Examples 5 to 7 and Comparative Examples 4 to 6 with a black ink with a color inkjet printer (PM750C) supplied by Seiko Epson Corp. Each printed portion was measured for a density with a densitometer (Macbeth RD918). Further, each printed portion was visually observed for a color formation state. Table 3 shows the results.

TABLE 1

| | Print density | Color formation state |
|---|---|---|
| Ex. 1 | 1.35 | Dense, clear and black color formation was obtained. |
| Ex. 2 | 1.36 | Dense, clear and black color formation was obtained. |
| Ex. 3 | 1.34 | Dense, clear and black color formation was obtained. |
| Ex. 4 | 1.33 | Dense, clear and black color formation was obtained. |
| CEx. 1 | 1.19 | Slightly grayish black color formation was obtained. |
| CEx. 2 | 1.17 | Slightly grayish black color formation was obtained. |
| CEx. 3 | 1.18 | Slightly grayish black color formation was obtained. |

Ex. = Example,
CEx. = Comparative Example

TABLE 2

| | Density of castor-oil-applied portion |
|---|---|
| Example 1 | 1.28 |
| Example 2 | 1.28 |

TABLE 2-continued

| | Density of castor-oil-applied portion |
|---|---|
| Example 3 | 1.29 |
| Example 4 | 1.26 |
| Comparative Example 1 | 0.88 |
| Comparative Example 2 | 0.79 |
| Comparative Example 3 | 0.77 |

TABLE 3

| | Print density | Color formation state |
|---|---|---|
| Ex. 5 | 1.41 | Dense, clear and black color formation was obtained. |
| Ex. 6 | 1.42 | Dense, clear and black color formation was obtained. |
| Ex. 7 | 1.44 | Dense, clear and black color formation was obtained. |
| CEx. 4 | 1.18 | Slightly grayish black color formation was obtained. |
| CEx. 5 | 1.13 | Slightly grayish black color formation was obtained. |
| CEx. 6 | 1.14 | Slightly grayish black color formation was obtained. |

Ex. = Example,
CEx. = Comparative Example

As shown in Examples 1 to 7 in Tables 1 to 3, when information recording layers were formed by curtain-coating of the coating composition films made of a plurality of layers each in which the intermediate coating solution layer for isolating two coating solution layers from one from the other was provided between said two coating solution layers which increased in viscosity when brought into contact, or mixed, with each other, there were obtained information recording materials having excellent quality of applied layers and having excellent various properties with good productivity.

In each of Comparative Examples 1 to 3, the heat-sensitive recording layer and the protective layer came into a state where they were intermingled, only a low color formation density was obtained, and the protective layer was poor in barrier properties. In each of Comparative Examples 4 to 6, the lower ink receptor layer and the upper ink receptor layer came into a state where they were intermingled, and only a low color formation density was obtained.

EXAMPLE 8

(A-2) Preparation of Heat-sensitive Recording Layer Coating Solution

Mixtures having the following compositions were dispersed with a ball mill to give liquids A-2-1, A-2-2 and A-2-3 having a volume average particle diameter of 1 $\mu$m and a liquid A-2-4 having a volume average particle diameter of 2 $\mu$m.

| Liquid A-2-1: | |
|---|---|
| 3-Dibutylamino-6-methyl-7-anilinofluorane | 40 parts |
| 10% Polyvinyl alcohol aqueous solution | 20 parts |
| Water | 40 parts |

| Liquid A-2-2: | |
|---|---|
| 4,4'-Bis(hydroxyphenyl)sulfone | 80 parts |
| 10% Polyvinyl alcohol aqueous solution | 40 parts |
| Water | 80 parts |

| Liquid A-2-3: | |
|---|---|
| 2-Benzyloxynaphthalene | 80 parts |
| 10% Polyvinyl alcohol aqueous solution | 40 parts |
| Water | 80 parts |

| Liquid A-2-4: | |
|---|---|
| Calcium carbonate (Callight SA, supplied by Shiraishi Kogyo Kaisha Ltd.) | 80 parts |
| Sodium polyacrylate | 1 part |
| Water | 79 parts |

The above-obtained liquids A-2-1, A-2-2, A-2-3 and A-2-4, 600 parts of a 10% polyvinyl alcohol aqueous solution, 67 parts of an emulsion which had a solid content of 30% and was formed of a carboxyl-group-containing polymer soluble upon a reaction with an alkali (SN-Thickener 926 supplied by San Nopco, Ltd.), 238 parts of water and 0.67 part of a fluorine-containing surfactant (Surflon S-111, supplied by Asahi Glass Co., Ltd.) were mixed to prepare a heat-sensitive recording layer coating solution.

(B-2) Preparation of Protective Layer Coating Solution

A mixture having the following composition was dispersed with a ball mill, to obtain a solution B-2 having a volume average particle diameter of 1 $\mu$m.

| Liquid B-2: | |
|---|---|
| Aluminum hydroxide (Higilite H42, supplied by Showa Denko K.K.) | 6 parts |
| Silane-modified polyvinyl alcohol (R2105, supplied by Kuraray Co., Ltd.) | 0.1 part |
| Water | 13.9 parts |

The above-obtained liquid B-2, 25 parts of a 40% zinc stearate dispersion, 1,000 parts of a 10% polyvinyl alcohol aqueous solution, 10 parts of 28% aqueous ammonia, 234 parts of water and 0.90 part of a fluorine-containing surfactant (Surflon S-111, supplied by Asahi Glass Co., Ltd.) were mixed to prepare a protective layer coating solution.

(C-2) Preparation of Heat-sensitive Recording Material

With a slide hopper type curtain coater, a coating composition film made of a heat-sensitive recording layer coating solution and a protective layer coating solution in this order from a lower layer side was formed from the heat-sensitive recording layer coating solution and the protective layer coating solution prepared in (A-2) and (B-2) such that the coating composition film had, per meter of a curtain width, a heat-sensitive recording layer coating solution flow rate of 4,000 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to give a heat-sensitive recording material. When the heat-sensitive recording layer coating solution and the protective layer coating solution in this Example were mixed, the viscosity of the mixture gradually increased with the passage of time.

EXAMPLE 9

(D-2) Preparation of Undercoat Layer Coating Solution

A mixture having the following composition was stirred with a homo-mixer, to prepare an undercoat layer coating solution.

| Undercoat layer coating solution: | |
|---|---|
| Calcined kaolin (Ansilex, supplied by Engelhard Corp.) | 100 parts |
| 50% Styrene-butadiene copolymer latex | 24 parts |
| 10% Starch aqueous solution (MS4600, supplied by Nippon Shokuhin Kako Co., Ltd.) | 60 parts |
| Sodium polyacrylate | 2 parts |
| 28% Aqueous ammonia | 10 parts |
| Water | 106 parts |
| Fluorine-containing surfactant (Surflon S-111, supplied by Asahi Glass Co., Ltd.) | 0.51 part |

(E-2) Preparation of Heat-sensitive Recording Layer Coating Solution

A heat-sensitive recording layer coating solution was prepared in the same manner as in (A-2) of Example 8.

(F-2) Preparation of Heat-sensitive Recording Material

With a slide hopper type curtain coater, a coating composition film made of an undercoat layer coating solution and a heat-sensitive recording layer coating solution in this order from a lower layer side was formed from the undercoat layer coating solution and the heat-sensitive recording layer coating solution prepared in (D-2) and (E-2) such that the coating composition film had, per meter of a curtain width, an undercoat layer coating solution flow rate of 4,000 ml/minute and a heat-sensitive recording layer coating solution flow rate of 4,000 ml/minute. And, the coating composition film was applied to a woodfree paper having a basis weight of 60 g/m$^2$ at an application rate of 200 m/minute, and the applied coating composition film was dried to give a heat-sensitive recording material. When the undercoat layer coating solution and the heat-sensitive recording layer coating solution in this Example were mixed, the viscosity of the mixture gradually increased with the passage of time.

EXAMPLE 10

(G-2) Preparation of Undercoat Layer

An undercoat layer coating solution was prepared in the same manner as in (D-2) of Example 9.

(H-2) Preparation of Heat-sensitive Recording Layer Coating Solution

A heat-sensitive recording layer coating solution was prepared in the same manner as in (A-2) of Example 8.

(I-2) Preparation of Protective Layer

A protective layer was prepared in the same manner as in (B-2) of Example 8.

(J-2) Preparation of Heat-sensitive Recording Material

With a slide hopper type curtain coater, a coating composition film made of an undercoat layer coating solution, a heat-sensitive recording layer coating solution and a protective layer coating solution in this order from a lower layer side was formed from the undercoat layer coating solution, the heat-sensitive recording layer coating solution and the protective layer coating solution prepared in (G-2), (H-2)

and (I-2) such that the coating composition film had, per meter of a curtain width, an undercoat layer coating solution flow rate of 4,000 ml/minute, a heat-sensitive recording layer coating solution flow rate of 4,000 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to give a heat-sensitive recording material. When the undercoat layer coating solution and the heat-sensitive recording layer coating solution in this Example were mixed, the viscosity of the mixture gradually increased with the passage of time. Further, when the heat-sensitive recording layer coating solution and the protective layer coating solution in this Example were mixed, the viscosity of the mixture gradually increased with the passage of time.

EXAMPLE 11

(K-2) Preparation of Lower Ink Receptor Layer Coating Solution

A mixture having the following composition was stirred with a homo-mixer, to prepare a lower ink receptor layer coating solution.

| Lower ink receptor layer coating solution: | |
|---|---|
| Synthetic amorphous silica (Mizukasil P78D, supplied by Mizusawa Industrial Chemicals, Ltd.) | 28 parts |
| 10% Polyvinyl alcohol aqueous solution | 40 parts |
| Emulsion which had a solid content of 30% and was formed of a carboxyl-group-containing polymer soluble upon a reaction with an alkali (SN-Thickener 926 supplied by San Nopco, Ltd.) | 5 parts |
| Water | 127 parts |
| Fluorine-containing surfactant (Surflon S-111, supplied by Asahi Glass Co., Ltd.) | 0.04 part |

(L-2) Preparation of Upper Ink Receptor Layer Coating Solution

A mixture having the following composition was stirred with a homo-mixer, to prepare an upper ink receptor layer coating solution.

| Upper ink receptor layer coating solution: | |
|---|---|
| Synthetic amorphous silica (Fineseal X37B, supplied by Tokuyama Corp.) | 21 parts |
| 10% Polyvinyl alcohol aqueous solution | 63 parts |
| Cationic polymer (Sumirez Resin 1001, supplied by Sumitomo Chemical Co., Ltd.) | 14 parts |
| 28% Aqueous ammonia | 10 parts |
| Water | 92 parts |
| Fluorine-containing surfactant (Surflon S-111, supplied by Asahi Glass Co., Ltd.) | 0.002 part |

(M-2) Preparation of Inkjet Recording Material

With a slide hopper type curtain coater, a coating composition film made of a lower ink receptor layer coating solution and an upper ink receptor layer coating solution in this order from a lower layer side was formed from the lower ink receptor layer coating solution and the upper ink receptor layer coating solution prepared in (K-2) and (L-2) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied to a woodfree paper having a basis weight of 60 g/m$^2$ at an application rate of 40 m/minute, and the applied coating composition film was dried to give an inkjet recording material. When the lower ink receptor layer coating solution and the upper ink receptor layer coating solution in this Example were mixed, the viscosity of the mixture gradually increased with the passage of time.

Comparative Example 7

A heat-sensitive recording material was prepared in the same manner as in Example 8 except that 67 parts of the emulsion which had a solid content of 30% and was formed of a carboxyl-group-containing polymer soluble upon a reaction with an alkali (SN-Thickener 926 supplied by San Nopco, Ltd.) in (A-2) of Example 8 was replaced with 67 parts of water, and that 10 parts of the 28% aqueous ammonia in (B-2) of Example 8 was replaced with 10 parts of water. When the heat-sensitive recording layer coating solution and the protective layer coating solution were mixed in this Comparative Example, the mixture did not increase in viscosity.

Comparative Example 8

A heat-sensitive recording layer coating solution and a protective layer coating solution were prepared in the same manner as in Example 8 except that 67 parts of the emulsion which had a solid content of 30% and was formed of a carboxyl-group-containing polymer soluble upon a reaction with an alkali (SN-Thickener 926 supplied by San Nopco, Ltd.) and 238 parts of the water in (A-2) of Example 8 were replaced with 200 parts of a 10% sodium alginate aqueous solution and 105 parts of water and that 10 parts of the 28 aqueous ammonia in (B-2) of Example 8 was replaced with 10 parts of calcium chloride. The heat-sensitive recording layer coating solution and the protective layer coating solution in this Comparative Example instantly increased in viscosity when mixed with each other. With a slide hopper type curtain coater, attempts were made to form a coating composition film made of a heat-sensitive recording layer coating solution and a protective layer coating solution in this order from a lower layer side such that the coating composition film had, per meter of a curtain width, a heat-sensitive recording layer coating solution flow rate of 4,000 ml/minute and a protective layer coating solution flow rate of 4,000 ml/minute. However, no coating composition film was formed, and no heat-sensitive recording material was obtained.

Comparative Example 9

A heat-sensitive recording material was prepared in the same manner as in Example 9 except that 10 parts of the 28% aqueous ammonia in (D-2) of Example 9 was replaced with 10 parts of water and that 67 parts of the emulsion which had a solid content of 30% and was formed of a carboxyl-group-containing polymer soluble upon a reaction with an alkali (SN-Thickener 926 supplied by San Nopco, Ltd.) in (E-2) of Example 9 was replaced with 67 parts of water. When the undercoat layer coating solution and the heat-sensitive recording layer coating solution in this Comparative Example were mixed, the mixture did not increase in viscosity.

Comparative Example 10

An undercoat layer coating solution was prepared in the same manner as in (D-2) of Example 9. A heat-sensitive recording layer coating solution was prepared in the same manner as in Example 9 except that 67 parts of the emulsion which had a solid content of 30% and was formed of a carboxyl-group-containing polymer soluble upon a reaction with an alkali (SN-Thickener 926 supplied by San Nopco, Ltd.) and 238 parts of the water in (E-2) of Example 9 were replaced with 201 parts of a 10% chitosan aqueous solution and 104 parts of water. The undercoat layer coating solution and the heat-sensitive recording layer coating solution in this Comparative Example instantly increased in viscosity when mixed with each other. With a slide hopper type curtain coater, attempts were made to form a coating composition film made of an undercoat layer coating solution and a heat-sensitive recording layer coating solution in this order from a lower layer side such that the coating composition film had, per meter of a curtain width, a heat-sensitive recording layer coating solution flow rate of 4,000 ml/minute and a protective layer coating solution flow rate of 4,000 ml/minute. However, no coating composition film was formed, and no heat-sensitive recording material was obtained.

Comparative Example 11

A heat-sensitive recording material was prepared in the same manner as in Example 10 except that 10 parts of the 28% aqueous ammonia in (G-2) of Example 10 was replaced with 10 parts of water, that 67 parts of the emulsion which had a solid content of 30% and was formed of a carboxyl-group-containing polymer soluble upon a reaction with an alkali (SN-Thickener 926 supplied by San Nopco, Ltd.) in (H-2) of Example 10 was replaced with 67 parts of water and that 10 parts of the 28% aqueous ammonia in (I-2) of Example 10 was replaced with 10 parts of water. When the undercoat layer coating solution and the heat-sensitive recording layer coating solution in this Comparative Example were mixed, the mixture did not increase in viscosity. When the heat-sensitive recording layer coating solution and the protective layer coating solution in this Comparative Example were mixed, the mixture did not increase in viscosity.

Comparative Example 12

An inkjet recording material was prepared in the same manner as in Example 11 except that 5 parts of the emulsion which had a solid content of 30% and was formed of a carboxyl-group-containing polymer soluble upon a reaction with an alkali (SN-Thickener 926 supplied by San Nopco, Ltd.) in (K-2) of Example 11 was replaced with 5 parts of water and that 10 parts of the 28% aqueous ammonia in (L-2) of Example 11 was replaced with 10 parts of water. When the lower ink receptor layer coating solution and the upper ink receptor layer coating solution in this Comparative Example were mixed, the mixture did not increase in viscosity.

Comparative Example 13

A lower ink receptor layer coating solution and an upper ink receptor layer coating solution were prepared in the same manner as in Example 11 except that 5 parts of the emulsion which had a solid content of 30% and was formed of a carboxyl-group-containing polymer soluble upon a reaction with an alkali (SN-Thickener 926 supplied by San Nopco, Ltd.) and 127 parts of the water in (K-2) of Example 11 were replaced with 15 parts of a 10% sodium alginate aqueous solution and 117 parts of water and that 10 parts of the 28% aqueous ammonia in (L-2) of Example 11 was replaced with 10 parts of calcium chloride. The lower ink receptor layer coating solution and the upper ink receptor layer coating solution in this Comparative Example instantly increased in viscosity when mixed with each other. With a slide hopper type curtain coater, attempts were made to form a coating composition film made of a lower ink receptor layer coating solution and an upper ink receptor layer coating solution in this order from a lower layer side such that the coating composition film had, per meter of a curtain width, a lower ink receptor layer coating solution flow rate of 7,200 ml/minute and an upper ink receptor layer coating solution flow rate of 2,100 ml/minute. However, no coating composition film was formed, and no inkjet recording material was obtained.

Test 4 Printing on Heat-sensitive Recording Material with Thermal Head

A print having a width of 5 cm and a length of 5 cm was made on each of the heat-sensitive recording materials prepared in Examples 8 to 10 and Comparative Examples 7, 9 and 11 with a thermal facsimile printing test machine (TH-PMD) supplied by Ohkura Electric Co., Ltd. equipped with a printing head (LH4409) supplied by TDK Corp. at an application pulse of 1.2 milliseconds and an applied voltage of 20 V. Each printed portion was measured for a density with a densitometer (Macbeth RD918). Further, each printed portion was visually observed for a color formation state. Table 4 shows the results.

Test 5 Test of Protective Layer of Heat-sensitive Recording Material for Barrier Properties A print having a width of 5 cm and a length of 5 cm was made on each of the heat-sensitive recording materials prepared in Examples 8 and 10 and Comparative Examples 7 and 11 with a thermal facsimile printing test machine (TH-PMD) supplied by Ohkura Electric Co., Ltd. equipped with a printing head (LH4409) supplied by TDK Corp. at an application pulse of 1.2 milliseconds and an applied voltage of 20 V. Then, castor oil was applied to each printed portion, and after 2 hours, each of the castor-oil-applied portions was measured for a density with a densitometer (Macbeth RD918). Table 5 shows the results.

Test 6 Printing on Inkjet Recording Material with Inkjet Printer

A print having a width of 5 cm and a length of 5 cm was made on each of the inkjet recording materials obtained in Example 11 and Comparative Example 12 with a black ink with a color inkjet printer (PM750C) supplied by Seiko Epson Corp. Each printed portion was measured for a density with a densitometer (Macbeth RD918). Further, each printed portion was visually observed for a color formation state. Table 6 shows the results.

TABLE 4

| | Print density | Color formation state |
|---|---|---|
| Ex. 8 | 1.27 | Dense, clear and black color formation was obtained. |
| Ex. 9 | 1.42 | Dense, clear and black color formation was obtained. |
| Ex. 10 | 1.35 | Dense, clear and black color formation was obtained. |
| CEx. 7 | 1.17 | Slightly grayish black color formation was obtained. |

TABLE 4-continued

| | Print density | Color formation state |
|---|---|---|
| CEx. 9 | 1.22 | Slightly grayish black color formation was obtained. |
| CEx. 11 | 1.07 | Slightly grayish black color formation was obtained. |

Ex. = Example,
CEx. = Comparative Example

Table 5

| | Density of castor-oil-applied portion |
|---|---|
| Example 8 | 1.27 |
| Example 10 | 1.38 |
| Comparative Example 7 | 0.85 |
| Comparative Example 11 | 0.74 |

TABLE 6

| | Print density | Color formation state |
|---|---|---|
| Ex. 11 | 1.43 | Dense, clear and black color formation was obtained. |
| CEx. 12 | 1.19 | Slightly grayish black color formation was obtained. |

Ex. = Example
CEx. = Comparative Example

As shown in Examples 8 to 11 in Tables 4 to 6, when information recording layers are formed by curtain-coating a coating composition film comprising at least one set of adjacent two layers of which the viscosity increases with the passage of time when the two layers are brought into contact, or mixed, with each other, whereby there were obtained information recording materials having excellent in the quality of coating layers and excellent in various properties with good productivity.

In Comparative Example 7, the heat-sensitive recording layer and the protective layer came into a state where they were mixed, only a low color density was obtained, and the protective layer was very poor in barrier properties. In Comparative Example 8, the heat-sensitive recording layer coating solution and the protective layer coating solution instantly had a high viscosity when brought into contact with each other on the head of the slide hopper type curtain coater, and the flowability of the coating solutions was lost. Therefore, no coating composition film made of a plurality of layers was formed, and no heat-sensitive recording material was obtained. In Comparative Example 9, the undercoat layer and the heat-sensitive recording layer came into a state where they were intermingled, so that only a low color density was obtained. In Comparative Example 10, the undercoat layer coating solution and the heat-sensitive recording layer coating solution instantly had a high viscosity when brought into contact with each other on the head of the slide hopper type curtain coater, and the flowability of the coating solutions was lost. Therefore, no coating composition film made of a plurality of layers was formed, and no heat-sensitive recording material was obtained. In Comparative Example 11, the undercoat layer and the heat-sensitive recording layer came into a state where they were intermingled, and the heat-sensitive recording layer and the protective layer came into a state where they were intermingled, so that only a low color density was obtained and that the protective layer was very poor in barrier properties. In Comparative Example 12, the lower ink receptor layer and the upper ink receptor layer came into a state where they were intermingled, and only a low color density was obtained. In Comparative Example 13, the lower ink receptor layer and the upper ink receptor layer instantly had a high viscosity when brought into contact with each other on the head of the slide hopper type curtain coater, and the flowability of the coating solutions was lost. Therefore, no coating composition film made of a plurality of layers was formed, and no inkjet recording material was obtained.

EXAMPLE 12

(A-3) Preparation of Heat-sensitive Recording Layer Coating Solution

Mixtures having the following compositions were dispersed with a ball mill to give liquids A-3-1, A-3-2 and A-3-3 having a volume average particle diameter of 1 $\mu$m and a liquid A-3-4 having a volume average particle diameter of 2 $\mu$m.

| Liquid A-3-1: | |
|---|---|
| 3-Dibutylamino-6-methyl-7-anilinofluorane | 40 parts |
| 10% Polyvinyl alcohol aqueous solution | 20 parts |
| Water | 40 parts |

| Liquid A-3-2: | |
|---|---|
| 4,4'-Bis (hydroxyphenyl) sulfone | 80 parts |
| 10% Polyvinyl alcohol aqueous solution | 40 parts |
| Water | 80 parts |

| Liquid A-3-3: | |
|---|---|
| 2-Benzyloxynaphthalene | 80 parts |
| 10% Polyvinyl alcohol aqueous solution | 40 parts |
| Water | 80 parts |

| Liquid A-3-4: | |
|---|---|
| Calcium carbonate | 80 parts |
| Sodium polyacrylate | 1 part |
| Water | 79 parts |

The above-obtained liquids A-3-1, A-3-2, A-3-3 and A-3-4, 600 parts of a 10% polyvinyl alcohol aqueous solution, 67 parts of an emulsion which had a solid content of 30% and was formed of a carboxyl-group-containing polymer soluble upon a reaction with an alkali (SN-Thickener 926 supplied by San Nopco, Ltd.), 238 parts of water and 0.67 part of fluorine-containing surfactant (Surflon S-111, supplied by Asahi Glass Co., Ltd.) were mixed, to prepare a heat-sensitive recording layer coating solution having a surface tension of 30 mN/m.

(B-3) Preparation of Protective Layer

A mixture having the following composition was dispersed with a ball mill, to give a liquid B-3 having a volume average particle diameter of 1 $\mu$m.

| Liquid B-3 | |
|---|---|
| Aluminum hydroxide | 6 parts |
| Sodium polyacrylate | 0.1 part |
| Water | 13.9 Parts |

The above-obtained liquid B-3, 25 parts of a 40% zinc stearate dispersion, 1,000 parts of a 10% polyvinyl alcohol aqueous solution, 10 parts of 28% aqueous ammonia and 234 parts of water were mixed, to prepare a protective layer coating solution having a surface tension of 34 mN/m.

(C-3) Preparation of Heat-sensitive Recording Material

With a slide hopper type curtain coater, a coating composition film made of a heat-sensitive recording layer coating solution and a protective layer coating solution in this order from a lower layer side was formed from the heat-sensitive recording layer coating solution and the protective layer coating solution prepared in (A-3) and (B-3) such that the coating composition film had, per meter of a curtain width, a heat-sensitive recording layer coating solution flow rate of 4,000 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to give a heat-sensitive recording material. When the heat-sensitive recording layer coating solution and the protective layer coating solution in this Example were mixed, the viscosity of the mixture gradually increased with the passage of time.

EXAMPLE 13

(D-3) Preparation of Undercoat Layer Coating Solution

A mixture having the following composition was stirred with a homo-mixer, to prepare an undercoat layer coating solution having a surface tension of 30 mN/m.

| Undercoat layer coating solution: | |
|---|---|
| Calcined kaolin | 100 parts |
| 50% Styrene-butadiene copolymer latex | 24 parts |
| 10% Starch aqueous solution | 60 parts |
| Sodium polyacrylate | 2 parts |
| 28% Aqueous ammonia | 10 parts |
| Water | 106 parts |
| Fluorine-containing surfactant (Surflon S-111, supplied by Asahi Glass Co., Ltd.) | 0.51 part |

(E-3) Preparation of Heat-sensitive Recording Layer Coating Solution

A heat-sensitive recording layer coating solution having a surface tension of 40 mN/m was prepared under the same conditions as those in (A-3) of Example 12 except that 0.67 parts of the fluorine-containing surfactant (Surflon S-111, supplied by Asahi Glass Co., Ltd.) in (A-3) of Example 12 was not added.

(F-3) Preparation of Heat-sensitive Recording Material

With a slide hopper type curtain coater, a coating composition film made of an undercoat layer coating solution and a heat-sensitive recording layer coating solution in this order from a lower layer side was formed from the undercoat layer coating solution and the heat-sensitive recording layer coating solution prepared in (D-3) and (E-3) such that the coating composition film had, per meter of a curtain width, an undercoat layer coating solution flow rate of 4,000 ml/minute and a heat-sensitive recording layer coating solution flow rate of 4,000 ml/minute. And, the coating composition film was applied to a woodfree paper having a basis weight of 60 g/m$^2$ at an application rate of 200 m/minute, and the applied coating composition film was dried to give a heat-sensitive recording material. When the undercoat layer coating solution and the heat-sensitive recording layer coating solution in this Example were mixed, the viscosity of the mixture gradually increased with the passage of time.

EXAMPLE 14

(G-3) Preparation of Undercoat Layer Coating Solution

A mixture having the following composition was stirred with a homo-mixer, to prepare an undercoat layer coating solution having a surface tension of 30 mN/m.

| Undercoat layer coating solution: | |
|---|---|
| Calcined kaolin | 100 parts |
| 50% Styrene-butadiene copolymer latex | 24 parts |
| 10% Starch aqueous solution | 60 parts |
| Sodium polyacrylate | 2 parts |
| Water | 116 parts |
| Fluorine-containing surfactant (Surflon S-111, supplied by Asahi Glass Co., Ltd.) | 0.51 part |

(H-3) Preparation of Heat-sensitive Recording Layer Coating Solution

A heat-sensitive recording layer coating solution having a surface tension of 30 mN/m was prepared under the same conditions as those in (A-3) of Example 12.

(I-3) Preparation of Protective Layer Coating Solution

A protective layer coating solution having a surface tension of 35 mN/m was prepared under the same conditions as those in (B-3) of Example 12.

(J-3) Preparation of Heat-sensitive Recording Material

With a slide hopper type curtain coater, a coating composition film made of an undercoat layer coating solution, a heat-sensitive recording layer coating solution and a protective layer coating solution in this order from a lower layer side was formed from the undercoat layer coating solution, the heat-sensitive recording layer coating solution and the protective layer coating solution prepared in (G-3), (H-3) and (I-3) such that the coating composition film had, per meter of a curtain width, an undercoat layer coating solution flow rate of 4,000 ml/minute, a heat-sensitive recording layer coating solution flow rate of 4,000 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to give a heat-sensitive recording material. When the heat-sensitive recording layer coating solution and the protective layer coating solution in this Example were mixed, the viscosity of the mixture gradually increased with the passage of time.

EXAMPLE 15

(K-3) Preparation of Lower Ink Receptor Layer Coating Solution

A mixture having the following composition was stirred with a homo-mixer, to prepare a lower ink receptor layer coating solution having a surface tension of 35 mN/m.

| Lower ink receptor layer coating solution: | |
|---|---|
| Synthetic amorphous silica | 28 parts |
| 10% Polyvinyl alcohol aqueous solution | 40 parts |
| Emulsion which had a solid content of 30% and was formed of a carboxyl-group-containing polymer soluble upon a reaction with an alkali (SN-Thickener 926 supplied by San Nopco, Ltd.) | 5 parts |
| Water | 127 parts |
| Fluorine-containing surfactant (Surflon S-111, supplied by Asahi Glass Co., Ltd.) | 0.04 part |

(L-3) Preparation of Upper Ink Receptor Layer Coating Solution

A mixture having the following composition was stirred with a homo-mixer, to prepare an upper ink receptor layer coating solution having a surface tension of 40 mN/m.

| Upper ink receptor layer coating solution: | |
|---|---|
| Synthetic amorphous silica | 21 parts |
| 10% Polyvinyl alcohol aqueous solution | 63 parts |
| Cationic polymer (Sumirez Resin 1001, supplied by Sumitomo Chemical Co., Ltd.) | 14 parts |
| 28% Aqueous ammonia | 10 parts |
| Water | 90 parts |
| Polyoxyethylenealkylphenol-containing surfactant (NP-20, supplied by Nikko Chemicals Co., Ltd.) | 0.4 part |

(M-3) Preparation of Inkjet Recording Material

With a slide hopper type curtain coater, a coating composition film made of a lower ink receptor layer coating solution and an upper ink receptor layer coating solution in this order from a lower layer side was formed from the lower ink receptor layer coating solution and the upper ink receptor layer coating solution prepared in (K-3) and (L-3) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied to a woodfree paper having a basis weight of 60 g/m$^2$ at an application rate of 40 m/minute, and the applied coating composition film was dried to give an inkjet recording material. When the lower ink receptor layer coating solution and the upper ink receptor layer coating solution in this Example were mixed, the viscosity of the mixture gradually increased with the passage of time.

Comparative Example 14

A heat-sensitive recording material was prepared under the same conditions as those in Example 12 except that 67 parts of the emulsion which had a solid content of 30% and was formed of a carboxyl-group-containing polymer soluble upon a reaction with an alkali (SN-Thickener 926 supplied by San Nopco, Ltd.) in (A-3) of Example 12 was replaced with 67 parts of water, to prepare a heat-sensitive recording layer coating solution having a surface tension of 30 mN/m, and that 10 parts of the 28% aqueous ammonia in (B-3) of Example 12 was replaced 10 parts of water, to prepare a protective layer coating solution having a surface tension of 35 mN/m. When the heat-sensitive recording layer coating solution and the protective layer coating solution in this Comparative Example were mixed, the mixture did not increase in viscosity.

Comparative Example 15

A heat-sensitive recording material was prepared under the same conditions as those in Example 13 except that 10 parts of the 28% aqueous ammonia in (D-3) of Example 13 was replaced with 10 parts of water, to prepare an undercoat layer coating solution having a surface tension of 30 mN/m, and that 67 parts of the emulsion which had a solid content of 30% and was formed of a carboxyl-group-containing polymer soluble upon a reaction with an alkali (SN-Thickener 926 supplied by San Nopco, Ltd.) in (E-3) of Example 13 was replaced with 67 parts of water, to prepare a heat-sensitive recording layer coating solution having a surface tension of 40 mN/m. When the undercoat layer coating solution and the heat-sensitive recording layer coating solution in this Comparative Example were mixed, the mixture did not increase in viscosity.

Comparative Example 16

A heat-sensitive recording material was prepared in the same manner as in Example 14 except that 67 parts of the emulsion which had a solid content of 30% and was formed of a carboxyl-group-containing polymer soluble upon a reaction with an alkali (SN-Thickener 926 supplied by San Nopco, Ltd.) in (H-3) of Example 14 was replaced with 67 parts of water, to prepare a heat-sensitive recording layer coating solution having a surface tension of 30 mN/m, and that 10 parts of the 28% aqueous ammonia in (I-3) of Example 14 was replaced with 10 parts of water, to prepare a protective layer coating solution having a surface tension of 35 mN/m. When the heat-sensitive recording layer coating solution and the protective layer coating solution in this Comparative Example were mixed, the mixture did not increase in viscosity.

Comparative Example 17

An inkjet recording material was prepared in the same manner as in Example 15 except that 5 parts of the emulsion which had a solid content of 30% and was formed of a carboxyl-group-containing polymer soluble upon a reaction with an alkali (SN-Thickener 926 supplied by San Nopco, Ltd.) in (K-3) of Example 15 was replaced with 5 parts of water, to prepare a lower ink receptor layer coating solution having a surface tension of 35 mN/m, and that 10 parts of the 28% aqueous ammonia in (L-3) of Example 15 was replaced with 10 parts of water, to prepare an upper ink receptor layer coating solution having a surface tension of 40 mN/m. When the lower ink receptor layer coating solution and the upper ink receptor layer coating solution in this Comparative Example were mixed, the mixture did not increase in viscosity.

Comparative Example 18

A heat-sensitive recording material was prepared under the same conditions as those in Example 12 except that 67 parts of the emulsion which had a solid content of 30% and was formed of a carboxyl-group-containing polymer soluble upon a reaction with an alkali (SN-Thickener 926 supplied by San Nopco, Ltd.) in (A-3) of Example 12 was replaced with 67 parts of water, to prepare a heat-sensitive recording layer coating solution having a surface tension of 30 mN/m, that 10 parts of the 28% aqueous ammonia in (B-3) of Example 12 was replaced with 10 parts of water, and further that 0.9 part of a fluorine-containing surfactant (Surflon S-111, supplied by Asahi Glass Co., Ltd.) was added, to prepare a protective layer coating solution having a surface tension of 25 mN/m. When the heat-sensitive recording layer coating solution and the protective layer coating solution in this Comparative Example were mixed, the mixture did not increase in viscosity.

Comparative Example 19

A heat-sensitive recording material was prepared under the same conditions as those in Example 13 except that 10 parts of the 28% aqueous ammonia in (D-3) of Example 13 was replaced with 10 parts of water, to prepare an undercoat layer coating solution having a surface tension of 30 mN/m, that 67 parts of the emulsion which had a solid content of 30% and was formed of a carboxyl-group-containing polymer soluble upon a reaction with an alkali (SN-Thickener 926 supplied by San Nopco, Ltd.) in (E-3) of Example 13 was replaced with 67 parts of water, and further that 1.4 parts of a fluorine-containing surfactant (Surflon S-111, supplied by Asahi Glass Co., Ltd.) was added, to prepare a heat-sensitive recording layer coating solution having a surface tension of 28 mN/m. When the undercoat layer coating solution and the heat-sensitive recording layer coating solution in this Comparative Example were mixed, the mixture did not increase in viscosity.

Comparative Example 20

A heat-sensitive recording material was prepared under the same conditions as those in Example 14 except that 67 parts of the emulsion which had a solid content of 30% and was formed of a carboxyl-group-containing polymer soluble upon a reaction with an alkali (SN-Thickener 926 supplied by San Nopco, Ltd.) in (H-3) of Example 14 was replaced with 67 parts of water, to prepare a heat-sensitive recording layer coating solution having a surface tension of 30 mN/m, that 10 parts of the 28% aqueous ammonia in (I-3) of Example 14 was replaced with 10 parts of water, and further that 0.9 part of a fluorine-containing surfactant (Surflon S-111, supplied by Asahi Glass Co., Ltd.) was added, to prepare a protective layer coating solution having a surface tension of 25 mN/m. When the heat-sensitive recording layer coating solution and the protective layer coating solution in this Comparative Example were mixed, the mixture did not increase in viscosity.

Comparative Example 21

An inkjet recording material was prepared under the same conditions as those in Example 15 except that 5 parts of the emulsion which had a solid content of 30% and was formed of a carboxyl-group-containing polymer soluble upon a reaction with an alkali (SN-Thickener 926 supplied by San Nopco, Ltd.) in (K-3) of Example 15 was replaced with 5 parts of water, to prepare a lower ink receptor layer coating solution having a surface tension of 35 mN/m, that 10 parts of the 28% aqueous ammonia in (L-3) of Example 15 was replaced with 10 parts of water and further that the amount of the polyoxyethylenealkylphenol-containing surfactant (NP-20, supplied by Nikko Chemicals Co., Ltd.) was changed from 0.4 part to 2 parts, to prepare an upper ink receptor layer having a surface tension of 28 mN/m. When the lower ink receptor layer coating solution and the upper ink receptor layer coating solution in this Comparative Example were mixed, the mixture did not increase in viscosity.

Test 7 Printing on Heat-sensitive Recording Material with Thermal Head

A print having a width of 5 cm and a length of 5 cm was made on each of the heat-sensitive recording materials prepared in Examples 12 to 14 and Comparative Examples 14 to 16 and 18 to 20 with a thermal facsimile printing test machine (TH-PMD) supplied by Ohkura Electric Co., Ltd. equipped with a printing head (LH4409) supplied by TDK Corp. at an application pulse of 1.2 milliseconds and an applied voltage of 20 V. Each printed portion was measured for a density with a densitometer (Macbeth RD918) . Further, each printed portion was visually observed for a color formation state. Table 7 shows the results.

Test 8 Test of Protective Layer of Heat-sensitive Recording Material for Barrier Properties A print having a width of 5 cm and a length of 5 cm was made on each of the heat-sensitive recording materials prepared in Examples 12 and 14 and Comparative Examples 14, 16, 18 and 20 with a thermal facsimile printing test machine (TH-PMD) supplied by Ohkura Electric Co., Ltd. equipped with a printing head (LH4409) supplied by TDK Corp. at an application pulse of 1.2 milliseconds and an applied voltage of 20 V. Then, a food wrap was allowed to be in contact with each printed portion, and after 6 hours, each of the portions with which the food wrap had been in contact was measured for a density with a densitometer (Macbeth RD918). Table 8 shows the results. Table 8 shows the results.

Test 9 Writing on Heat-sensitive Recording Material with Paint-stick

The heat-sensitive recording materials prepared in Examples 12 to 14 and Comparative Examples 14 to 16 and 18 to 20 were used to write on non-printed portions thereof with a paint-stick ("Rashion pen" (phonetically), marking feltnib pen, supplied by Teranishi Chemical Industry Co., Ltd.), and the non-printed portions were visually observed for writability. Table 9 shows the results.

Test 10 Printing on Inkjet Recording Material with Inkjet Printer

A print having a width of 5 cm and a length of 5 cm was made on each of the inkjet recording materials obtained in Example 15 and Comparative Examples 17 and 21 with a black ink with a color inkjet printer (PM750C) supplied by Seiko Epson Corp. Each printed portion was measured for a density with a densitometer (Macbeth RD918). Further, each printed portion was visually observed for a color formation state. Table 10 shows the results.

TABLE 7

| | Print density | Color formation state |
|---|---|---|
| Ex. 12 | 1.28 | Dense, clear and black color formation was obtained. |
| Ex. 13 | 1.40 | Dense, clear and black color formation was obtained. |
| Ex. 14 | 1.36 | Dense, clear and black color formation was obtained. |
| CEx. 14 | 1.22 | Protective layer had water-drops-like defect, and color formation was non-uniform. |
| CEx. 15 | 1.05 | Heat-sensitive recording layer had water-drops-like defect, and color formation was non-uniform. |
| CEx. 16 | 1.15 | Protective layer had water-drops-like defect, and color formation was non-uniform. |
| CEx. 18 | 1.16 | Color formation was uniform, but color density was low. |
| CEx. 19 | 1.20 | Color formation was uniform, but color density was low. |
| CEx. 20 | 1.08 | Color formation was uniform, but color density was low. |

Ex. = Example,
CEx. = Comparative Example

TABLE 8

| | Density of portion in which food wrap was in contact |
|---|---|
| Example 12 | 1.27 |
| Example 14 | 1.34 |
| Comparative Example 14 | 0.79 |
| Comparative Example 16 | 0.88 |
| Comparative Example 18 | 1.13 |
| Comparative Example 20 | 1.23 |

TABLE 9

| | Writability |
|---|---|
| Example 12 | Uniform writing was accepted. |
| Example 13 | Uniform writing was accepted. |
| Example 14 | Uniform writing was accepted. |
| Comparative Example 14 | Uniform writing was accepted. |
| Comparative Example 15 | Uniform writing was accepted. |
| Comparative Example 16 | Uniform writing was accepted. |
| Comparative Example 18 | Ink was partly repelled. |
| Comparative Example 19 | Ink was repelled. |
| Comparative Example 20 | Ink was repelled. |

TABLE 10

| | Print density | Color formation state |
|---|---|---|
| Ex. 15 | 1.65 | Dense, clear and black color formation was obtained. |
| CEx. 17 | 1.64 | Upper ink receptor layer had water-drops-like defect, and color formation was non-uniform. |
| CEx. 21 | 1.22 | Color formation was uniform, but color density was low. |

As shown in Examples 12 to 15 in Tables 7 to 10, in two layers consisting of the uppermost layer and the adjacent lower layer constituting the coating composition film made of a plurality of layers, the coating solution of the above uppermost layer had a higher surface tension than the coating solution of the above adjacent lower layer, and when the coating solution of the above uppermost layer and the coating solution of the above adjacent lower layer were brought into contact, or mixed, with each other, the mixture increased in viscosity with the passage of time. By curtain-coating the coating composition films having the above constitution to form information recording materials, there were obtained information recording materials having an excellent quality of layers formed by application and having higher performances with good productivity.

In Comparative Example 14, the protective layer coating solution came into a state where it was repelled on the heat-sensitive recording layer coating solution, only a non-uniform color formation was obtained, and the protective layer was very poor in barrier properties. In Comparative Example 15, the heat-sensitive recording layer coating solution came into a state where it was repelled on the undercoat layer coating solution, and no uniform color formation was obtained. In Comparative Example 16, the protective layer coating solution came into a state where it was repelled on the heat-sensitive recording layer coating solution, only a non-uniform color formation was obtained, and the protective layer was very poor in barrier properties. In Comparative Example 17, the upper ink receptor layer coating solution came into a state where it was repelled on the lower ink receptor layer coating solution, and the color formation state was non-uniform. In Comparative Examples 18 to 20, uniform color formation was obtained, but the writability with a paint stick was poor due to addition of a larger amount of the surfactant to the coating solution for the uppermost layer. In Comparative Example 21, uniform color formation was attained, but the color density was low since a larger amount of the surfactant was added to the coating solution for the upper ink receptor layer.

EXAMPLE 16

(A-4) Preparation of Heat-sensitive Recording Layer Coating Solution

Mixtures having the following compositions were dispersed with a ball mill to give liquids A-4-1, A-4-2 and A-4-3 having a volume average particle diameter of 1 $\mu$m and a liquid A-4-4 having a volume average particle diameter of 2 $\mu$m.

| Liquid A-4-1: | |
|---|---|
| 3-Dibutylamino-6-methyl-7-anilinofluorane | 40 parts |
| 10% Polyvinyl alcohol aqueous solution | 20 parts |
| Water | 40 parts |

| Liquid A-4-2: | |
|---|---|
| 4,4'-Bis (hydroxyphenyl) sulfone | 80 parts |
| 10% Polyvinyl alcohol aqueous solution | 40 parts |
| Water | 80 parts |

| Liquid A-4-3: | |
|---|---|
| 2-Benzyloxynaphthalene | 80 parts |
| 10% Polyvinyl alcohol aqueous solution | 40 parts |
| Water | 80 parts |

| Liquid A-4-4: | |
|---|---|
| Calcium carbonate (Callight SA, supplied by Shiraishi Kogyo Kaisha, Ltd.) | 80 parts |
| Sodium polyacrylate | 1 part |
| Water | 79 parts |

The above-obtained liquids A-4-1, A-4-2, A-4-3 and A-4-4, 600 parts of a 10% polyvinyl alcohol aqueous solution, 305 parts of water and 0.67 part of a fluorine-containing surfactant (Surflon S-111, supplied by Asahi Glass Co., Ltd.) were mixed, to prepare a heat-sensitive recording layer coating solution.

(B-4) Preparation of Protective Layer Coating Solution

A mixture having the following composition was dispersed with a ball mill, to give a liquid B-4 having a volume average particle diameter of 1 $\mu$m.

| Liquid B-4 | |
|---|---|
| Aluminum hydroxide (Higilite H42, supplied by Showa Denko K. K.) | 6 parts |
| Sodium hexameta-phosphate | 0.1 part |
| Water | 13.9 parts |

The above-obtained liquid B-4, 25 parts of a 40% zinc stearate dispersion, 1,000 parts of a 10% polyvinyl alcohol aqueous solution, 244 parts of water and 0.90 part of a fluorine-containing surfactant (Surflon S-111, supplied by Asahi Glass Co., Ltd.) were mixed, to prepare a protective layer coating solution.

(C-4) Preparation of Heat-sensitive Recording Material

By means of an apparatus having an air knife applicator, a slide hopper type curtain coater positioned immediately thereafter and a dryer positioned thereafter, water was applied to a woodfree paper having a basis weight of 60 g/m$^2$ with the air knife applicator at an application rate of 200 m/minute under an application weight of 30 g/m$^2$. Immediately thereafter, with the slide hopper type curtain coater, a coating composition film made of a heat-sensitive recording layer coating solution and a protective layer coating solution in this order from a lower layer side was formed from the heat-sensitive recording layer coating solution and the protective layer coating solution prepared in (A-4) and (B-4) such that the coating composition film had, per meter of a curtain width, a heat-sensitive recording layer coating solution flow rate of 4,000 ml/minute and a protective layer coating solution flow rate of 4,000 ml/minute. And, the coating composition film was applied, and the applied coating composition film was dried to give a heat-sensitive recording material.

EXAMPLE 17

(D-4) Preparation of Polyvinyl Alcohol Aqueous Solution

A mixture having the following composition was stirred with a mixer with heating it with steam, and when and after the temperature of the mixture reached 90° C., the mixture was stirred for 30 minutes without heating. Then, the mixture was allowed to cool naturally to 30° C., to give an aqueous solution.

| | |
|---|---|
| Polyvinyl alcohol (PVA117, supplied by Kuraray Co., Ltd.) | 5 parts |
| Water | 95 parts |

(E-4) Preparation of Heat-sensitive Recording Material

By means of an apparatus having an air knife applicator, a slide hopper type curtain coater positioned immediately thereafter and a dryer positioned thereafter, the aqueous solution prepared in (D-4) was applied to a woodfree paper having a basis weight of 60 g/m$^2$ with the air knife applicator at an application rate of 200 m/minute under an application weight of 30 g/m$^2$. Immediately thereafter, with the slide hopper type curtain coater, a coating composition film made of a heat-sensitive recording layer coating solution and a protective layer coating solution in this order from a lower layer side was formed from the heat-sensitive recording layer coating solution and the protective layer coating solution prepared in (A-4) and (B-4) such that the coating composition film had, per meter of a curtain width, a heat-sensitive recording layer coating solution flow rate of 4,000 ml/minute and a protective layer coating solution flow rate of 4,000 ml/minute. And, the coating composition film was applied, and the applied coating composition film was dried to give a heat-sensitive recording material.

EXAMPLE 18

(F-4) Preparation of Styrene-butadiene Copolymer Latex Aqueous Solution

A mixture having the following composition was stirred with a mixer, to prepare an aqueous solution.

| | |
|---|---|
| 43% Styrene-butadiene copolymer latex (LX415A, supplied by Zeon Corp.) | 11.6 parts |
| Water | 88.4 parts |

(G-4) Preparation of Heat-sensitive Recording Material

By means of an apparatus having an air knife applicator, a slide hopper type curtain coater positioned immediately thereafter and a dryer positioned thereafter, the aqueous solution prepared in (F-4) was applied to a woodfree paper having a basis weight of 60 g/m$^2$ with the air knife applicator at an application rate of 200 m/minute under an application weight of 30 g/m$^2$. Immediately thereafter, with the slide hopper type curtain coater, a coating composition film made of a heat-sensitive recording layer coating solution and a protective layer coating solution in this order from a lower layer side was formed from the heat-sensitive recording layer coating solution and the protective layer coating solution prepared in (A-4) and (B-4) such that the coating composition film had, per meter of a curtain width, a heat-sensitive recording layer coating solution flow rate of 4,000 ml/minute and a protective layer coating solution flow rate of 4,000 ml/minute. And, the coating composition film was applied, and the applied coating composition film was dried to give a heat-sensitive recording material.

EXAMPLE 19

(H-4) Preparation of Starch Aqueous Solution

A mixture having the following composition was stirred with a mixer with heating it with steam, and when and after the temperature of the mixture reached 90° C., the mixture was stirred for 30 minutes without heating. Then, the mixture was allowed to cool naturally to 30° C., to give an aqueous solution.

| | |
|---|---|
| Phosphoric-esterified starch (MS4600, supplied by Nippon Shokuhin Kako Co., Ltd.) | 5 parts |
| Water | 95 parts |

(I-4) Preparation of Heat-sensitive Recording Material

By means of an apparatus having an air knife applicator, a slide hopper type curtain coater positioned immediately thereafter and a dryer positioned thereafter, the aqueous solution prepared in (H-4) was applied to a woodfree paper having a basis weight of 60 g/m$^2$ with the air knife applicator at an application rate of 200 m/minute under an application weight of 30 g/m$^2$. Immediately thereafter, with the slide hopper type curtain coater, a coating composition film made of a heat-sensitive recording layer coating solution and a protective layer coating solution in this order from a lower layer side was formed from the heat-sensitive recording layer coating solution and the protective layer coating solution prepared in (A-4) and (B-4) such that the coating composition film had, per meter of a curtain width, a heat-sensitive recording layer coating solution flow rate of 4,000 ml/minute and a protective layer coating solution flow rate of 4,000 ml/minute. And, the coating composition film was applied, and the applied coating composition film was dried to give a heat-sensitive recording material.

EXAMPLE 20

(J-4) Preparation of Aluminum Hydroxide Aqueous Solution

A mixture having the following composition was stirred with a homo-mixer, to prepare an aqueous solution.

| | |
|---|---|
| Sodium hexameta-phosphate | 0.1 part |
| Aluminum hydroxide (Higilite H42, supplied by Showa Denko K.K.) | 5 parts |
| 10% Polyvinyl alcohol aqueous solution (PVA117, supplied by Kuraray Co., Ltd.) | 5 parts |
| Water | 89.9 parts |

(K-4) Preparation of Heat-sensitive Recording Material

By means of an apparatus having an air knife applicator, a slide hopper type curtain coater positioned immediately thereafter and a dryer positioned thereafter, the aqueous solution prepared in (J-4) was applied to a woodfree paper having a basis weight of 60 g/m$^2$ with the air knife applicator at an application rate of 200 m/minute under an application weight of 30 g/m$^2$. Immediately thereafter, with the slide hopper type curtain coater, a coating composition film made of a heat-sensitive recording layer coating solution and a protective layer coating solution in this order from a lower layer side was formed from the heat-sensitive recording layer coating solution and the protective layer coating solution prepared in (A-4) and (B-4) such that the coating composition film had, per meter of a curtain width, a heat-sensitive recording layer coating solution flow rate of 4,000 ml/minute and a protective layer coating solution flow rate of 4,000 ml/minute. And, the coating composition film was applied, and the applied coating composition film was dried to give a heat-sensitive recording material.

Comparative Example 22

With a slide hopper type curtain coater, a coating composition film made of a heat-sensitive recording layer coating solution and a protective layer coating solution in this order from a lower layer side was formed from the heat-sensitive recording layer coating solution and the protective layer coating solution prepared in (A-4) and (B-4) such that the coating composition film had, per meter of a curtain width, a heat-sensitive recording layer coating solution flow rate of 4,000 ml/minute and a protective layer coating solution flow rate of 4,000 ml/minute. And, the coating composition film was applied to a woodfree paper having a basis weight of 60 g/m$^2$ under the condition of an application rate of 200 m/minute, and the applied coating composition film was dried to obtain a heat-sensitive recording material.

Comparative Example 23

(S-4) Preparation of Application Base Paper

The aqueous solution prepared in (D-4) was applied to a woodfree paper having a basis weight of 60 g/m$^2$ with the air knife applicator of the above application apparatus at a rate of 200 m/minute under the condition of an application weight of 30 g/m$^2$, and the applied aqueous solution was dried as it was, to prepare an application base paper.

(T-4) Preparation of Heat-sensitive Recording Material

Then, only with the slide hopper type curtain coater of the above apparatus, a coating composition film made of a heat-sensitive recording layer coating solution and a protective layer coating solution in this order from a lower layer side was formed from the heat-sensitive recording layer coating solution and the protective layer coating solution prepared in (A-4) and (B-4) such that the coating composition film had, per meter of a curtain width, a heat-sensitive recording layer coating solution flow rate of 4,000 ml/minute and a protective layer coating solution flow rate of 4,000 ml/minute. And, the coating composition film was applied to the application base paper prepared in (S-4) under the condition of an application rate of 200 m/minute, and the applied coating composition film was dried to obtain a heat-sensitive recording material.

Comparative Example 24

(U-4) Preparation of Application Base Paper

The aqueous solution prepared in (F-4) was applied to a woodfree paper having a basis weight of 60 g/m$^2$ with the air knife applicator of the above application apparatus at a rate of 200 m/minute under the condition of an application weight of 30 g/m$^2$, and the applied aqueous solution was dried as it was, to prepare an application base paper.

(V-4) Preparation of Heat-sensitive Recording Material

Then, only with the slide hopper type curtain coater of the above apparatus, a coating composition film made of a heat-sensitive recording layer coating solution and a protective layer coating solution in this order from a lower layer side was formed from the heat-sensitive recording layer coating solution and the protective layer coating solution prepared in (A-4) and (B-4) such that the coating composition film had, per meter of a curtain width, a heat-sensitive recording layer coating solution flow rate of 4,000 ml/minute and a protective layer coating solution flow rate of 4,000 ml/minute. And, the coating composition film was applied to the application base paper prepared in (U-4) at an application rate of 200 m/minute, and the applied coating composition film was dried to obtain a heat-sensitive recording material.

Comparative Example 25

(W-4) Preparation of Application Base Paper

The aqueous solution prepared in (J-4) was applied to a woodfree paper having a basis weight of 60 g/m$^2$ with the air knife applicator of the above application apparatus at a rate of 200 m/minute under the condition of an application weight of 30 g/m$^2$, and the applied aqueous solution was dried as it was, to prepare an application base paper.

(X-4) Preparation of Heat-sensitive Recording Material

Then, only with the slide hopper type curtain coater of the above apparatus, a coating composition film made of a heat-sensitive recording layer coating solution and a protective layer coating solution in this order from a lower layer side was formed from the heat-sensitive recording layer coating solution and the protective layer coating solution prepared in (A-4) and (B-4) such that the coating composition film had, per meter of a curtain width, a heat-sensitive recording layer coating solution flow rate of 4,000 ml/minute and a protective layer coating solution flow rate of 4,000 ml/minute. And, the coating composition film was applied to the application base paper prepared in (W-4) at an application rate of 200 m/minute, and the applied coating composition film was dried to obtain a heat-sensitive recording material.

Test 11 Printing on Heat-sensitive Recording Material with Thermal Head

A print having a width of 5 cm and a length of 5 cm was made on each of the heat-sensitive recording materials prepared in Examples 16 to 20 and Comparative Examples 22 to 25 with a thermal facsimile printing test machine (TH-PMD) supplied by Ohkura Electric Co., Ltd. equipped with a printing head (LH4409) supplied by TDK Corp. at an application pulse of 1.2 milliseconds and an applied voltage of 20 V. Each printed portion was measured for a density with a densitometer (Macbeth RD918). Further, each printed portion was visually observed for a color formation state. Table 11 shows the results.

In Table 11, print densities are shown on the basis of the following ratings. ◎ shows that a heat-sensitive recording material attains a particularly high print density, ○ shows that a heat-sensitive recording material attains a high print density, Δ shows that a heat-sensitive recording material attains a more or less practically acceptable print density, and X shows that a printed portion on a heat-sensitive recording material has a low print density or is not uniform so that a print was not practically acceptable.

TABLE 11

| | Print density | Color formation state |
|---|---|---|
| Ex. 16 | ○ | Dense, clear and black color formation was obtained. |
| Ex. 17 | ◎ | Dense, clear and black color formation was obtained. |
| Ex. 18 | ◎ | Dense, clear and black color formation was obtained. |
| Ex. 19 | ○ | Dense, clear and black color formation was obtained. |
| Ex. 20 | ○ | Dense, clear and black color formation was obtained. |
| CEx. 22 | Δ | Black color formation was obtained. |
| CEx. 23 | ○ | Clear and black color formation was obtained. |
| CEx. 24 | X | Clear and black color formation was obtained. |
| CEx. 25 | X | Grayish black color formation was obtained. |

Ex. = Example,
CEx. = Comparative Example

Evaluations:

As shown in Examples 16 to 20 in Table 11, water or the aqueous liquid was applied to the surface on which the coating composition film was to be formed, and in a non-dry state, the coating composition film was applied by curtain-coating immediately thereafter to form the information recording layer. In this manner, there were obtained information recording materials having a good quality of applied layers and having excellent various properties each with good productivity.

In Comparative Examples 22 and 25, the heat-sensitive recording layer and the protective layer came into a state where they were intermingled, and only a low color density was obtained as compared with Examples 16 to 20. In Comparative Example 25, the print came into a grayish state as a whole. In Comparative Example 23, a high print density was obtained. However, the productivity was poor, since the application with an air knife applicator was followed by drying and then followed by the step of applying the heat-sensitive recording layer coating solution and the protective layer coating solution with a slide hopper type curtain coater, so that it was required to carry out applications twice. In Comparative Example 24, a hydrophobic film was formed on the aqueous solution surface, which resulted in preventing the heat-sensitive recording layer coating solution and the protective layer coating solution from spreading uniformly, and the heat-sensitive recording material had water-drops-like failure in color formation when printing was carried out.

EXAMPLE 21

(L-4) Preparation of Lower Ink Receptor Layer Coating Solution

A mixture having the following composition was stirred with a homo-mixer, to prepare a lower ink receptor layer coating solution.

| | |
|---|---|
| Synthetic amorphous silica (Mizukasil P78D, supplied by Mizusawa Industrial Chemicals, Ltd.) | 28 parts |
| 10% Polyvinyl alcohol aqueous solution | 40 parts |
| Water | 132 parts |
| Fluorine-containing surfactant (Surflon S-111, supplied by Asahi Glass Co., Ltd.) | 0.04 part |

(M-4) Preparation of Upper Ink Receptor Layer Coating Solution

A mixture having the following composition was stirred with a homo-mixer, to prepare an upper ink receptor layer coating solution.

| | |
|---|---|
| Synthetic amorphous silica (Fineseal X37B, supplied by Tokuyama Corp.) | 21 parts |
| 10% Polyvinyl alcohol aqueous solution | 63 parts |
| Cationic polymer (Sumirez Resin 1001, supplied by Sumitomo Chemical Co., Ltd.) | 14 parts |
| Water | 102 parts |
| Fluorine-containing surfactant (Surflon S-111, supplied by Asahi Glass Co., Ltd.) | 0.002 part |

(N-4) Preparation of Inkjet Recording Material

By means of an apparatus having an air knife applicator, a slide hopper type curtain coater positioned immediately thereafter and a dryer positioned thereafter, water was applied to a woodfree paper having a basis weight of 60 g/m$^2$ with the air knife applicator at an application rate of 40 m/minute under an application weight of 30 g/m$^2$. Immediately thereafter, with the slide hopper type curtain coater, a coating composition film made of a lower ink receptor layer coating solution and an upper ink receptor layer coating solution in this order from a lower layer side was formed from the lower ink receptor layer coating solution and the upper ink receptor layer coating solution prepared in (L-4) and (M-4) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied, and the applied coating composition film was dried to give an inkjet recording material.

EXAMPLE 22

(O-4) Preparation of Inkjet Recording Material

By means of an apparatus having an air knife applicator, a slide hopper type curtain coater positioned immediately thereafter and a dryer positioned thereafter, the aqueous solution prepared in (D-4) was applied to a woodfree paper having a basis weight of 60 g/m$^2$ with the air knife applicator at an application rate of 40 m/minute under an application weight of 30 g/m2. Immediately thereafter, with the slide hopper type curtain coater, a coating composition film made of a lower ink receptor layer coating solution and an upper ink receptor layer coating solution in this order from a lower layer side was formed from the lower ink receptor layer coating solution and the upper ink receptor layer coating solution prepared in (L-4) and (M-4) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied, and the applied coating composition film was dried to give an inkjet recording material.

EXAMPLE 23

(P-4) Preparation of Inkjet Recording Material

By means of an apparatus having an air knife applicator, a slide hopper type curtain coater positioned immediately thereafter and a dryer positioned thereafter, the aqueous solution prepared in (F-4) was applied to a woodfree paper having a basis weight of 60 g/m$^2$ with the air knife applicator at an application rate of 40 m/minute under an application weight of 30 g/m2. Immediately thereafter, with the slide hopper type curtain coater, a coating composition film made of a lower ink receptor layer coating solution and an upper ink receptor layer coating solution in this order from a lower layer side was formed from the lower ink receptor layer coating solution and the upper ink receptor layer coating solution prepared in (L-4) and (M-4) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied, and the applied coating composition film was dried to give an inkjet recording material.

EXAMPLE 24

(Q-4) Preparation of Inkjet Recording Material

By means of an apparatus having an air knife applicator, a slide hopper type curtain coater positioned immediately thereafter and a dryer positioned thereafter, the aqueous solution prepared in (H-4) was applied to a woodfree paper having a basis weight of 60 g/m$^2$ with the air knife applicator at an application rate of 40 m/minute under an application weight of 30 g/m$^2$. Immediately thereafter, with the slide hopper type curtain coater, a coating composition film made of a lower ink receptor layer coating solution and an upper ink receptor layer coating solution in this order from a lower layer side was formed from the lower ink receptor layer coating solution and the upper ink receptor layer coating solution prepared in (L-4) and (M-4) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied, and the applied coating composition film was dried to give an inkjet recording material.

EXAMPLE 25

(R-4) Preparation of Inkjet Recording Material

By means of an apparatus having an air knife applicator, a slide hopper type curtain coater positioned immediately thereafter and a dryer positioned thereafter, the aqueous solution prepared in (J-4) was applied to a woodfree paper having a basis weight of 60 g/m$^2$ with the air knife applicator at an application rate of 40 m/minute under an application weight of 30 g/m$^2$. Immediately thereafter, with the slide hopper type curtain coater, a coating composition film made of a lower ink receptor layer coating solution and an upper ink receptor layer coating solution in this order from a lower layer side was formed from the lower ink receptor layer coating solution and the upper ink receptor layer coating solution prepared in (L-4) and (M-4) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied, and the applied coating composition film was dried to give an inkjet recording material.

Comparative Example 26

With a slide hopper type curtain coater, a coating composition film made of a lower ink receptor layer coating solution and an upper ink receptor layer coating solution in this order from a lower layer side was formed from the lower ink receptor layer coating solution and the upper ink receptor layer coating solution prepared in (L-4) and (M-4) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied to a woodfree paper having a basis weight of 60 g/m$^2$ under a condition of an application rate of 40 m/minute, and the applied coating composition film was dried to give an inkjet recording material.

Comparative Example 27

(Y-4) Preparation of Application Base Paper

The aqueous solution prepared in (D-4) was applied to a woodfree paper having a basis weight of 60 g/m$^2$ with the air knife applicator of the above application apparatus at an application rate of 40 m/minute under an application weight of 30 g/m$^2$, and the applied aqueous solution was dried as it was, to prepare an application base paper.

(Z-4) Preparation of Inkjet Recording Material

Then, only with the slide hopper type curtain coater of the above application apparatus, a coating composition film made of a lower ink receptor layer coating solution and an upper ink receptor layer coating solution in this order from a lower layer side was formed from the lower ink receptor layer coating solution and the upper ink receptor layer coating solution prepared in (L-4) and (M-4) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied to the application base paper prepared in (Y-4) at an application rate of 40 m/minute, and the applied coating composition film was dried to obtain an inkjet recording material.

Comparative Example 28

(AA-4) Preparation of Application Base Paper

The aqueous solution prepared in (F-4) was applied to a woodfree paper having a basis weight of 60 g/m$^2$ with the air knife applicator of the above application apparatus at an application rate of 40 m/minute under an application weight of 30 g/m$^2$, and the applied aqueous solution was dried as it was, to prepare an application base paper.

(AB-4) Preparation of Inkjet Recording Material

Then, only with the slide hopper type curtain coater of the above application apparatus, a coating composition film made of a lower ink receptor layer coating solution and an upper ink receptor layer coating solution in this order from a lower layer side was formed from the lower ink receptor layer coating solution and the upper ink receptor layer coating solution prepared in (L-4) and (M-4) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied to the application base paper prepared in (AA-4) at an application rate of 40 m/minute, and the applied coating composition film was dried to obtain an inkjet recording material.

Comparative Example 29

(AC-4) Preparation of Application Base Paper

The aqueous solution prepared in (J-4) was applied to a woodfree paper having a basis weight of 60 g/m$^2$ with the air knife applicator of the above application apparatus at an application rate of 40 m/minute under an application weight of 30 g/m$^2$, and the applied aqueous solution was dried as it was, to prepare an application base paper.

(AD-4) Preparation of Inkjet Recording Material

Then, only with the slide hopper type curtain coater of the above application apparatus, a coating composition film made of a lower ink receptor layer coating solution and an upper ink receptor layer coating solution in this order from a lower layer side was formed from the lower ink receptor layer coating solution and the upper ink receptor layer coating solution prepared in (L-4) and (M-4) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied to the application base paper prepared in (AC-4) at an application rate of 40 m/minute, and the applied coating composition film was dried to obtain an inkjet recording material.

Test 12 Printing on Inkjet Recording Material with Inkjet Printer

A print having a width of 5 cm and a length of 5 cm was made on each of the inkjet recording materials obtained in Examples 21 to 25 and Comparative Examples 26 and 29 with a black ink with a color inkjet printer (PM750C) supplied by Seiko Epson Corp. Each printed portion was measured for a density with a densitometer (Macbeth RD918). Further, each printed portion was visually observed for a color formation state. Table 12 shows the results.

In Table 12, print densities are shown on the basis of the following ratings. ◎ shows that an inkjet recording material attains a particularly high print density and has particularly high ink-absorbing capability, ○ shows that an inkjet recording material attains a high print density and has high ink-absorbing capability, Δ shows that an inkjet recording material attains a more or less practically acceptable print density and has more or less practically acceptable ink-absorbing capability, and X shows that the print density and the ink-absorbing capability are low or a printed portion is not uniform, so that a print was not practically acceptable.

TABLE 12

| | Print density | Color formation state |
|---|---|---|
| Ex. 21 | ○ | Bleeding-free, clear and black color formation was obtained. |
| Ex. 22 | ◎ | Bleeding-free, clear and black color formation was obtained. |
| Ex. 23 | ◎ | Bleeding-free, clear and black color formation was obtained. |
| Ex. 24 | ○ | Bleeding-free, clear and black color formation was obtained. |
| Ex. 25 | ○ | Bleeding-free, clear and black color formation was obtained. |
| CEx. 26 | Δ | Print density was lightly low. |

TABLE 12-continued

| | Print density | Color formation state |
|---|---|---|
| CEx. 27 | ○ | Ink-absorbing capability was poor, and bleeding took place. |
| CEx. 28 | X | Non-uniformity caused by repellency of ink on surface took place. |
| CEx. 29 | X | Print density was very low. |

Ex. = Example,
CEx. = Comparative Example

Evaluations:

As shown in Examples 21 to 25 in Table 12, water or the aqueous liquid was applied to the surface on which the coating composition film was to be formed, and in a non-dry state, the coating composition film was applied by curtain-coating immediately thereafter to form the information recording layer. In this manner, there were obtained information recording materials having a good quality of applied layers and having excellent various properties each with good productivity.

In Comparative Example 26, the lower ink receptor layer and the upper ink receptor layer came into a state where they were intermingled like Comparative Example 22, and the inkjet recording material showed a slightly low color density. In Comparative Example 27, the ink-absorbing capability was poor and bleeding took place although the print density was high. In Comparative Example 28, a hydrophobic coating was formed on the aqueous liquid surface, which resulted in preventing the lower ink receptor layer coating solution and the upper ink receptor layer coating solution from spreading uniformly, and the inkjet recording material showed color non-uniformity caused by repellency of ink when printing was carried out. In Comparative Example 29, ink infiltrated deep into the recording material, which resulted in a low color density.

EXAMPLE 26

(A-5) Preparation of Heat-sensitive Recording Layer Coating Solution

Mixtures having the following compositions were dispersed with a ball mill to give liquids A-5-1, A-5-2 and A-5-3 having a volume average particle diameter of 1 μm and a liquid A-5-4 having a volume average particle diameter of 2 μm.

| Liquid A-5-1: | |
|---|---|
| 3-Dibutylamino-6-methyl-7-anilinofluorane | 40 parts |
| 10% Polyvinyl alcohol aqueous solution | 20 parts |
| Water | 40 parts |

| Liquid A-5-2: | |
|---|---|
| 4,4'-Bis(hydroxyphenyl)sulfone | 80 parts |
| 10% Polyvinyl alcohol aqueous solution | 40 parts |
| Water | 80 parts |

| Liquid A-5-3: | |
|---|---|
| 2-Benzyloxynaphthalene | 80 parts |
| 10% Polyvinyl alcohol aqueous solution | 40 parts |
| Water | 80 parts |

| Liquid A-5-4: | |
|---|---|
| Calcium carbonate (Callight SA, supplied by Shiraishi Kogyo Kaisha, Ltd.) | 80 parts |
| Sodium polyacrylate | 1 part |
| Water | 79 parts |

The above-obtained liquids A-5-1, A-5-2, A-5-3 and A-5-4, 600 parts of a 10% polyvinyl alcohol aqueous solution, 2,260 parts of water and 1.4 parts of a fluorine-containing surfactant (Surflon S-111, supplied by Asahi Glass Co., Ltd.) were mixed, to prepare a heat-sensitive recording layer coating solution having a water content of 90%.

(B-5) Preparation of Protective Layer Coating Solution

A mixture having the following composition was dispersed with a ball mill, to give a liquid B-5 having a volume average particle diameter of 1 $\mu$m.

| Liquid B-5 | |
|---|---|
| Aluminum hydroxide (Higilite H42, supplied by Showa Denko K.K.) | 6 parts |
| Sodium polyacrylate | 0.1 part |
| Water | 13.9 parts |

The above-obtained liquid B-5, 25 parts of a 40% zinc stearate dispersion, 1,000 parts of a 10% polyvinyl alcohol aqueous solution, 244 parts of water and 0.90 part of a fluorine-containing surfactant (Surflon S-111, supplied by Asahi Glass Co., Ltd.) were mixed, to prepare a protective layer coating solution.

(C-5) Preparation of Heat-sensitive Recording Material

With a slide hopper type curtain coater, a coating composition film made of a heat-sensitive recording layer coating solution and a protective layer coating solution in this order from a lower layer side was formed from the heat-sensitive recording layer coating solution and the protective layer coating solution prepared in (A-5) and (B-5) such that the coating composition film had, per meter of a curtain width, a heat-sensitive recording layer coating solution flow rate of 9,000 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to obtain a heat-sensitive recording material.

EXAMPLE 27

(D-5) Preparation of Lowermost Layer Coating Solution

A lowermost layer coating solution having the following composition and having a water content of 99.5% was prepared.

| Lowermost-layer coating solution: | |
|---|---|
| Water | 99.5 parts |
| Fluorine-containing surfactant (Surflon S-111, supplied by Asahi Glass Co., Ltd.) | 0.5 part |

(E-5) Preparation of Heat-sensitive Recording Layer Coating Solution

Liquids E-5-1, E-5-2, E-5-3 and E-5-4 were prepared under the same conditions as those in the preparation of the liquids A-5-1, A-5-2, A-5-3 and A-5-4 in (A-5) of Example 26. The above-obtained liquids E-5-1, E-5-2, E-5-3 and E-5-4, 600 parts of a 10% polyvinyl alcohol aqueous solution, 305 parts of water and 0.67 part of a fluorine-containing surfactant (Surflon S-111, supplied by Asahi Glass Co., Ltd.) were mixed, to prepare a heat-sensitive recording layer coating solution having a water content of 77.5%.

(F-5) Preparation of Protective Layer Coating Solution

A protective layer coating solution was prepared under the same conditions as those in (B-5) of Example 26.

(G-5) Preparation of Heat-sensitive Recording Material

With a slide hopper type curtain coater, a coating composition film made of a lowermost layer coating solution, a heat-sensitive recording layer coating solution and a protective layer coating solution in this order from a lower layer side was formed from the lowermost layer coating solution, the heat-sensitive recording layer coating solution and the protective layer coating solution prepared in (D-5), (E-5) and (F-5) such that the coating composition film had, per meter of a curtain width, a lowermost layer coating solution flow rate of 2,000 ml/minute, a heat-sensitive recording layer coating solution flow rate of 4,000 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to obtain a heat-sensitive recording material.

EXAMPLE 28

(H-5) Preparation of Lowermost Layer Coating Solution

A lowermost layer coating solution having the following composition and having a water content of 90% was prepared.

| Lowermost layer coating solution: | |
|---|---|
| 9.5% Polyvinyl alcohol aqueous solution | 99.5 parts |
| Fluorine-containing surfactant (Surflon S-111, supplied by Asahi Glass Co., Ltd.) | 0.5 part |

(I-5) Preparation of Heat-sensitive Recording Layer Coating Solution

A heat-sensitive recording layer having a water content of 77.5% was prepared under the same conditions as those in (E-5) of Example 27.

(J-5) Preparation of Protective Layer Coating Solution

A protective layer coating solution was prepared under the same conditions as those in (B-5) of Example 26.

(K-5) Preparation of Heat-sensitive Recording Material

With a slide hopper type curtain coater, a coating composition film made of a lowermost layer coating solution, a heat-sensitive recording layer coating solution and a protective layer coating solution in this order from a lower layer side was formed from the lowermost layer coating solution, the heat-sensitive recording layer coating solution and the protective layer coating solution prepared in (H-5), (I-5) and (J-5) such that the coating composition film had, per meter of a curtain width, a lowermost layer coating solution flow rate of 2,000 ml/minute, a heat-sensitive recording layer coating solution flow rate of 4,000 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to obtain a heat-sensitive recording material.

EXAMPLE 29

(L-5) Preparation of Lowermost Layer Coating Solution

A mixture having the following composition was stirred with a homo-mixer, to prepare a lowermost layer coating solution having a water content of 90%.

| Lowermost layer coating solution: | |
|---|---|
| Aluminum hydroxide (Higilite H42, supplied by Showa Denko K.K.) | 10 parts |
| 10% Polyvinyl alcohol aqueous solution | 10 parts |
| Fluorine-containing surfactant (Surflon S-111, supplied by Asahi Glass Co., Ltd.) | 0.5 part |
| Water | 95 parts |

(M-5) Preparation of Heat-sensitive Recording Layer Coating Solution

A heat-sensitive recording layer having a water content of 77.5% was prepared under the same conditions as those in (E-5) of Example 27.

(N-5) Preparation of Protective Layer Coating Solution

A protective layer coating solution was prepared under the same conditions as those in (B-5) of Example 26.

(O -5) Preparation of Heat-sensitive Recording Material

With a slide hopper type curtain coater, a coating composition film made of a lowermost layer coating solution, a heat-sensitive recording layer coating solution and a protective layer coating solution in this order from a lower layer side was formed from the lowermost layer coating solution, the heat-sensitive recording layer coating solution and the protective layer coating solution prepared in (L-5), (M-5) and (N-5) such that the coating composition film had, per meter of a curtain width, a lowermost layer coating solution flow rate of 2,000 ml/minute, a heat-sensitive recording layer coating solution flow rate of 4,000 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to obtain a heat-sensitive recording material.

EXAMPLE 30

(AA-5) Preparation of Lower Ink Receptor Layer Coating Solution

A mixture having the following composition was stirred with a homo-mixer, to prepare a lower ink receptor layer coating solution having a water content of 90%.

| Lower ink receptor layer coating solution: | |
|---|---|
| Synthetic amorphous silica (Mizukasil P78D, supplied by Mizusawa Industrial Chemicals, Ltd.) | 28 parts |
| 10% Polyvinyl alcohol aqueous solution | 40 parts |
| Water | 253 parts |
| Fluorine-containing surfactant (Surflon S-111, supplied by Asahi Glass Co., Ltd.) | 0.08 part |

(BA-5) Preparation of Upper Ink Receptor Layer Coating Solution

A mixture having the following composition was stirred with a homo-mixer, to prepare an upper ink receptor layer coating solution.

| Upper ink receptor layer coating solution: | |
|---|---|
| Synthetic amorphous silica (Fineseal X37B, supplied by Tokuyama Corp.) | 21 parts |
| 10% Polyvinyl alcohol aqueous solution | 63 parts |
| Cationic polymer (Sumirez Resin 1001, supplied by Sumitomo Chemical Co., Ltd.) | 14 parts |
| Water | 102 parts |
| Fluorine-containing surfactant (Surflon S-111, supplied by Asahi Glass Co., Ltd.) | 0.002 part |

(CA-5) Preparation of Inkjet Recording Material

With a slide hopper type curtain coater, a coating composition film made of a lower ink receptor layer coating solution and an upper ink receptor layer coating solution in this order from a lower layer side was formed from the lower ink receptor layer coating solution and the upper ink receptor layer coating solution prepared in (AA-5) and (BA-5) such that the coating composition film had, per meter of a curtain width, a lower ink receptor layer coating solution flow rate of 11,600 ml/minute and an upper ink receptor layer coating solution flow rate of 2,100 ml/minute. And, the coating composition film was applied to a woodfree paper having a basis weight of 60 g/m$^2$ at an application rate of 40 m/minute, and the applied coating composition film was dried to give an inkjet recording material.

EXAMPLE 31

(DA-5) Preparation of Lowermost Layer Coating Solution

A lowermost layer coating solution having a water content of 88.5% was prepared under the same conditions as those in (D-5) of Example 27.

(EA-5) Preparation of Lower Ink Receptor Layer Coating Solution

A mixture having the following composition was stirred with a homo-mixer, to prepare a lower ink receptor layer coating solution having a water content of 84%.

| Lower ink receptor layer coating solution: | |
|---|---|
| Synthetic amorphous silica (Mizukasil P78D, supplied by Mizusawa Industrial Chemicals, Ltd.) | 28 parts |
| 10% Polyvinyl alcohol aqueous solution | 40 parts |
| Water | 132 parts |
| Fluorine-containing surfactant (Surflon S-111, supplied by Asahi Glass Co., Ltd.) | 0.04 part |

(FA-5) Preparation of Upper Ink Receptor Layer Coating Solution

An upper ink receptor layer was prepared under the same conditions as those in (BA-5) of Example 30.

(GA-5) Preparation of Inkjet Recording Material

With a slide hopper type curtain coater, a coating composition film made of a lowermost layer coating solution, a lower ink receptor layer coating solution and an upper ink receptor layer coating solution in this order from a lower layer side was formed from the lowermost layer coating solution, the lower ink receptor layer coating solution and the upper ink receptor layer coating solution prepared in (DA-5), (EA-5) and (FA-5) such that the coating composition film had, per meter of a curtain width, a lowermost layer coating solution flow rate of 2,000 ml/minute, a lower ink receptor layer coating solution flow rate of 7,200 ml/minute and an upper ink receptor layer coating solution flow rate of 2,100 ml/minute. And, the coating composition film was applied to a woodfree paper having a basis weight of 60 g/m$^2$ at an application rate of 40 m/minute, and the applied coating composition film was dried to give an inkjet recording material.

EXAMPLE 32

(HA-5) Preparation of Lowermost Layer Coating Solution

A lowermost layer coating solution having a water content of 90% was prepared under the same conditions as those in (H-5) of Example 28.

(IA-5) Preparation of Lower Ink Receptor Layer Coating Solution

A lower ink receptor layer coating solution having a water content of 84% was prepared under the same conditions as those in (EA-5) of Example 31.

(JA-5) Preparation of Upper Ink Receptor Layer Coating Solution

An upper ink receptor layer coating solution was prepared under the same conditions as those in (FA-5) of Example 31.

(KA-5) Preparation of Inkjet Recording Material

With a slide hopper type curtain coater, a coating composition film made of a lowermost layer coating solution, a lower ink receptor layer coating solution and an upper ink receptor layer coating solution in this order from a lower layer side was formed from the lowermost layer coating solution, the lower ink receptor layer coating solution and the upper ink receptor layer coating solution prepared in (HA-5), (IA-5) and (JA-5) such that the coating composition film had, per meter of a curtain width, a lowermost layer coating solution flow rate of 2,000 ml/minute, a lower ink receptor layer coating solution flow rate of 7,200 ml/minute and an upper ink receptor layer coating solution flow rate of 2,100 ml/minute. And, the coating composition film was applied to a woodfree paper having a basis weight of 60 g/m$^2$ at an application rate of 40 m/minute, and the applied coating composition film was dried to give an inkjet recording material.

EXAMPLE 33

(LA-5) Preparation of Lowermost Layer Coating Solution

A lowermost layer coating solution having a water content of 90% was prepared under the same conditions as those in (L-5) of Example 29.

(MA-5) Preparation of Lower Ink Receptor Layer Coating Solution

A lower ink receptor layer coating solution having a water content of 84% was prepared under the same conditions as those in (EA-5) of Example 31.

(NA-5) Preparation of Upper Ink Receptor Layer Coating Solution

An upper ink receptor layer coating solution was prepared under the same conditions as those in (BA-5) of Example 30.

(OA-5) Preparation of Inkjet Recording Material

With a slide hopper type curtain coater, a coating composition film made of a lowermost layer coating solution, a lower ink receptor layer coating solution and an upper ink receptor layer coating solution in this order from a lower layer side was formed from the lowermost layer coating solution, the lower ink receptor layer coating solution and the upper ink receptor layer coating solution prepared in (LA-5), (MA-5) and (NA-5) such that the coating composition film had, per meter of a curtain width, a lowermost layer coating solution flow rate of 2,000 ml/minute, a lower ink receptor layer coating solution flow rate of 7,200 ml/minute and an upper ink receptor layer coating solution flow rate of 2,100 ml/minute. And, the coating composition film was applied to a woodfree paper having a basis weight of 60 g/m$^2$ at an application rate of 40 m/minute, and the applied coating composition film was dried to give an inkjet recording material.

Comparative Example 30

(AB-5) Preparation of Heat-sensitive Recording Layer Coating Solution

A heat-sensitive recording layer coating solution having a water content of 77.5% was prepared under the same conditions as those in (E-5) of Example 27.

(BB-5) Preparation of Protective Layer Coating Solution

A protective layer coating solution was prepared under the same conditions as those in (B-5) of Example 26.

(CB-5) Preparation of Heat-sensitive Recording Material

With a slide hopper type curtain coater, a coating composition film made of a heat-sensitive recording layer coating solution and a protective layer coating solution in this order from a lower layer side was formed from the heat-sensitive recording layer coating solution and the protective layer coating solution prepared in (AB-5) and (BB-5) such that the coating composition film had, per meter of a curtain width, a heat-sensitive recording layer coating solution flow rate of 4,000 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to obtain a heat-sensitive recording material.

Comparative Example 31

(DB-5) Preparation of Lowermost Layer Coating Solution

A lowermost layer coating solution having the following composition and having a water content of 80% was prepared.

| Lowermost layer coating solution: | |
|---|---|
| 19.5% Polyvinyl alcohol aqueous solution | 99.5 parts |
| Fluorine-containing surfactant (Surflon S-111, supplied by Asahi Glass Co., Ltd.) | 0.5 part |

(EB-5) Preparation of Heat-sensitive Recording Layer Coating Solution

A heat-sensitive recording layer coating solution having a water content of 77.5% was prepared under the same conditions as those in Example 27.

(FB-5) Preparation of Protective Layer Coating Solution

A protective layer coating solution was prepared under the same conditions as those in (B-5) of Example 26.

(GB-5) Preparation of Heat-sensitive Recording Material

With a slide hopper type curtain coater, a coating composition film made of a lowermost layer coating solution, a heat-sensitive recording layer coating solution and a protective layer coating solution in this order from a lower layer side was formed from the lowermost layer coating solution, the heat-sensitive recording layer coating solution and the protective layer coating solution prepared in (DB-5), (EB-5) and (FB-5) such that the coating composition film had, per meter of a curtain width, a lowermost layer coating solution flow rate of 2,000 ml/minute, a heat-sensitive recording layer coating solution flow rate of 4,000 ml/minute and a protective layer coating solution flow rate of 4,000 ml/minute. And, the coating composition film was applied to a woodfree paper having a basis weight of 60 g/m$^2$ at an application rate of 200 m/minute, and the applied coating composition film was dried to obtain a heat-sensitive recording material.

Comparative Example 32

(HB-5) Preparation of Lowermost Layer Coating Solution

A lowermost layer coating solution having the following composition and having a water content of 80% was prepared.

| Lowermost layer coating solution: | |
|---|---|
| Aluminum hydroxide (Higilite H42, supplied by Showa Denko K.K.) | 20 parts |
| 10% Polyvinyl alcohol aqueous solution | 20 parts |
| Fluorine-containing surfactant (Surflon S-111, supplied by Asahi Glass Co., Ltd.) | 0.5 part |
| Water | 72 parts |

(IB-5) Preparation of Heat-sensitive Recording Layer Coating Solution

A heat-sensitive recording layer coating solution having a water content of 77.5% was prepared under the same conditions as those in (E-5) of Example 27.

(JB-5) Preparation of Protective Layer Coating Solution

A protective layer coating solution was prepared under the same conditions as those in (B-5) of Example 26.

(KB-5) Preparation of Heat-sensitive Recording Material

With a slide hopper type curtain coater, a coating composition film made of a lowermost layer coating solution, a heat-sensitive recording layer coating solution and a protective layer coating solution in this order from a lower layer side was formed from the lowermost layer coating solution, the heat-sensitive recording layer coating solution and the protective layer coating solution prepared in (HB-5), (IB-5) and (JB-5) such that the coating composition film had, per meter of a curtain width, a lowermost layer coating solution flow rate of 2,000 ml/minute, a heat-sensitive recording layer coating solution flow rate of 4,000 ml/minute and a protective layer coating solution flow rate of 4,000 ml/minute. And, the coating composition film was applied to a woodfree paper having a basis weight of 60 g/M$^2$ at an application rate of 200 m/minute, and the applied coating composition film was dried to obtain a heat-sensitive recording material.

Comparative Example 33

(LB-5) Preparation of Lower Ink Receptor Layer Coating Solution

A lower ink receptor layer coating solution having a water content of 84% was prepared under the same conditions as those in (EA-5) of Example 31.

(MB-5) Preparation of Upper Ink Receptor Layer Coating Solution

An upper ink receptor layer was prepared under the same conditions as those in (BA-5) of Example 30.

(NB-5) Preparation of Inkjet Recording Material

With a slide hopper type curtain coater, a coating composition film made of a lower ink receptor layer coating solution and an upper ink receptor layer coating solution in this order from a lower layer side was formed from the lower ink receptor layer coating solution and the upper ink receptor layer coating solution prepared in (LB-5) and (MB-5) such that the coating composition film had, per meter of a curtain width, a lower ink receptor layer coating solution flow rate of 7,200 ml/minute and an upper ink receptor layer coating solution flow rate of 2,100 ml/minute. And, the coating composition film was applied to a woodfree paper having a basis weight of 60 g/m$^2$ at an application rate of 40 m/minute, and the applied coating composition film was dried to give an inkjet recording material.

Comparative Example 34

(OB-5) Preparation of Lowermost Layer Coating Solution

A lowermost layer coating solution having a water content of 80% was prepared under the same conditions as those in (DB-5) of Comparative Example 31.

(PB-5) Preparation of Lower Ink Receptor Layer Coating Solution

A lower ink receptor layer coating solution having a water content of 84% was prepared under the same conditions as those in (EA-5) of Example 31.

(QB-5) Preparation of Upper Ink Receptor Layer Coating Solution

An upper ink receptor layer coating solution was prepared under the same conditions as those in (BA-5) of Example 30.

(RB-5) Preparation of Inkjet Recording Material

With a slide hopper type curtain coater, a coating composition film made of a lowermost layer coating solution, a lower ink receptor layer coating solution and an upper ink receptor layer coating solution in this order from a lower layer side was formed from the lowermost layer coating solution, the lower ink receptor layer coating solution and the upper ink receptor layer coating solution prepared in (OB-5), (PB-5) and (QB-5) such that the coating composition film had, per meter of a curtain width, a lowermost layer coating solution flow rate of 2,000 ml/minute, a lower ink receptor layer coating solution flow rate of 7,200 ml/minute and an upper ink receptor layer coating solution flow rate of 2,100 ml/minute. And, the coating composition film was applied to a woodfree paper having a basis weight of 60 g/m$^2$ at an application rate of 40 m/minute, and the applied coating composition film was dried to give an inkjet recording material.

Comparative Example 35

(SB-5) Preparation of Lowermost Layer Coating Solution

A lowermost layer coating solution having a water content of 80% was prepared under the same conditions as those in (HB-5) of Comparative Example 32.

(TB-5) Preparation of Lower Ink Receptor Layer Coating Solution

A lower ink receptor layer coating solution was prepared under the same conditions as those in (EA-5) of Example 31.

(UB-5) Preparation of Upper Ink Receptor Layer Coating Solution

An upper ink receptor layer coating solution was prepared under the same conditions as those in (BA-5) of Example 30.

(VB-5) Preparation of Inkjet Recording Material

With a slide hopper type curtain coater, a coating composition film made of a lowermost layer coating solution, a lower ink receptor layer coating solution and an upper ink receptor layer coating solution in this order from a lower layer side was formed from the lowermost layer coating solution, the lower ink receptor layer coating solution and the upper ink receptor layer coating solution prepared in (SB-5), (TB-5) and (UB-5) such that the coating composition film had, per meter of a curtain width, a lowermost layer coating solution flow rate of 2,000 ml/minute, a lower ink receptor layer coating solution flow rate of 7,200 ml/minute and an upper ink receptor layer coating solution flow rate of 2,100 ml/minute. And, the coating composition film was applied to a woodfree paper having a basis weight of 60 g/m$^2$ at an application rate of 40 m/minute, and the applied coating composition film was dried to give an inkjet recording material.

Test 13 Printing on Heat-sensitive Recording Material with Thermal Head

A print having a width of 5 cm and a length of 5 cm was made on each of the heat-sensitive recording materials prepared in Examples 26 to 29 and Comparative Examples 30 to 32 with a thermal facsimile printing test machine (TH-PMD) supplied by Ohkura Electric Co., Ltd. equipped with a printing head (LH4409) supplied by TDK Corp. at an application pulse of 1.2 milliseconds and an applied voltage of 20 V. Each printed portion was measured for a density with a densitometer (Macbeth RD918). Further, each printed portion was visually observed for a color formation state. Table 13 shows the results.

Test 14 Test of Protective Layer of Heat-sensitive Recording Material for Barrier Properties A print having a width of 5 cm and a length of 5 cm was made on each of the heat-sensitive recording materials prepared in Examples 26 to 29 and Comparative Examples 30 to 32 with a thermal facsimile printing test machine (TH-PMD) supplied by Ohkura Electric Co., Ltd. equipped with a printing head (LH4409) supplied by TDK Corp. at an application pulse of 1.2 milliseconds and an applied voltage of 20 V. Then, castor oil was applied to each printed portion, and after 2 hours, each of the castor-oil-applied portions was measured for a density with a densitometer (Macbeth RD918). Table 14 shows the results.

Test 15 Printing on Inkjet Recording Material with Inkjet Printer

A print having a width of 5 cm and a length of 5 cm was made on each of the inkjet recording materials obtained in Examples 30 to 33 and Comparative Examples 33 to 35 with a black ink with a color inkjet printer (PM750C) supplied by Seiko Epson Corp. Each printed portion was measured for a density with a densitometer (Macbeth RD918). Further, each printed portion was visually observed for a color formation state. Table 15 shows the results.

TABLE 13

| | Print density | Color formation state |
|---|---|---|
| Ex. 26 | 1.24 | Dense, clear and black color formation was obtained. |
| Ex. 27 | 1.29 | Dense, clear and black color formation was obtained. |
| Ex. 28 | 1.28 | Dense, clear and black color formation was obtained. |
| Ex. 29 | 1.26 | Dense, clear and black color formation was obtained. |
| CEx. 30 | 1.16 | Slightly grayish black color formation was obtained. |
| CEx. 31 | 1.19 | Slightly grayish black color formation was obtained. |
| CEx. 32 | 1.10 | Slightly grayish black color formation was obtained. |

Ex. = Example, CEx. = Comparative Example

TABLE 14

| | Density of castor-oil-applied portion |
|---|---|
| Example 26 | 1.21 |
| Example 27 | 1.25 |
| Example 28 | 1.27 |
| Example 29 | 1.24 |
| Comparative Example 30 | 0.85 |
| Comparative Example 31 | 0.94 |
| Comparative Example 32 | 0.82 |

TABLE 15

| | Print density | Color formation state |
|---|---|---|
| Ex. 30 | 1.42 | Dense, clear and black color formation was obtained. |
| Ex. 31 | 1.44 | Dense, clear and black color formation was obtained. |
| Ex. 32 | 1.46 | Dense, clear and black color formation was obtained. |
| Ex. 33 | 1.41 | Dense, clear and black color formation was obtained. |
| CEx. 33 | 1.20 | Slightly grayish black color formation was obtained. |
| CEx. 34 | 1.22 | Slightly grayish black color formation was obtained. |
| CEx. 35 | 1.18 | Slightly grayish black color formation was obtained. |

Ex. = Example, CEx. = Comparative Example

As shown in Examples 26 to 33 in Tables 13 to 15, information recording layers were formed by curtain-coating a coating composition film wherein a lowermost layer coating solution constituting the coating composition film made of a plurality of layers to be curtain-coated contains at least 90% by weight, whereby there were obtained information recording materials excellent in quality of applied layers and various properties with good productivity.

In Comparative Examples 30 to 32, the heat-sensitive recording layer and the protective layer came into a state where they were intermingled, so that only a low color density was obtained and that the protective layer had very poor barrier properties. In Comparative Examples 33 to 35, the lower ink receptor layer and the upper ink receptor layer came into a state where they were intermingled, and only a low color density was obtained.

Industrial Utility

According to the method of the present invention, there can be produced an information recording material excellent particularly in quality of applied layers and excellent in various properties with good productivity by multi-layered application method according to curtain-coating.

The information recording material obtained according to the method of the present invention can be used as a heat-sensitive recording material, an inkjet recording material, a magnetic recording material, and the like.

What is claimed is:

1. A process for producing an information recording material comprising a substrate and an information recording layer formed thereon, which comprises curtain-coating a coating composition film made of a plurality of layers to form part or the entirety of a plurality of layers constituting the information recording material, said coating composition film comprising at least one set of adjacent two layers of which the viscosity increases with the passage of time when they are brought into contact, or mixed, with each other, one of said adjacent two layers containing an emulsion of a carboxyl-group containing polymer that is soluble upon reaction with an alkali and the other of said adjacent layers containing the alkali, whereby the combination of the two layers gradually increases in viscosity after they are brought together.

2. The process for producing an information recording material as recited in claim 1, wherein said one set of adjacent two layers constituting the coating composition film made of a plurality of layers to be curtain-coated are an uppermost layer and a lower layer adjacent thereto, and a coating solution of said uppermost layer has a higher surface tension than a coating solution of said lower layer adjacent thereto.

3. The process for producing an information recording material as recited in claim 1, wherein the information recording material is a heat-sensitive recording material.

4. The process for producing an information recording material as recited in claim 1, wherein the information recording material is an inkjet recording material.

* * * * *